US010408441B1

(12) United States Patent
Yao et al.

(10) Patent No.: US 10,408,441 B1
(45) **Date of Patent: *Sep. 10, 2019**

(54) CURVED LED TUBULAR LAMP

(71) Applicant: ZHEJIANG SUPER LIGHTING ELECTRIC APPLIANCE CO., LTD, Jinyun (CN)

(72) Inventors: Wentao Yao, Enshi (CN); Weijun Zhu, Shangrao (CN); Zhaosong Lin, Jinyun (CN); Zhi Guo, Wuhan (CN)

(73) Assignees: Zhejiang Super Lighting Electric, Jinyun Industrial Area; Appliance Co., Ltd., Jinyun, Zhejiang (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/405,510

(22) Filed: May 7, 2019

Related U.S. Application Data

(63) Continuation of application No. 15/441,592, filed on Feb. 24, 2017, now Pat. No. 10,288,272.

(30) Foreign Application Priority Data

| | | |
|---|---|---|
| Mar. 17, 2016 | (CN) | 2016 1 0152885 |
| Mar. 18, 2016 | (CN) | 2016 2 0209317 U |
| Aug. 4, 2016 | (CN) | 2016 1 0642281 |
| Aug. 19, 2016 | (CN) | 2016 1 0700677 |

(51) Int. Cl.
*F21V 23/00* (2015.01)
*F21V 7/00* (2006.01)
(Continued)

(52) U.S. Cl.
CPC ..... *F21V 23/005* (2013.01); *F21K 9/272* (2016.08); *F21V 3/061* (2018.02); *F21V 7/005* (2013.01); *F21V 15/015* (2013.01); *F21V 17/101* (2013.01); *F21V 25/02* (2013.01); *F21V 29/85* (2015.01); *F21Y 2103/10* (2016.08);
(Continued)

(58) Field of Classification Search
CPC ..... F21Y 2103/30; F21Y 2103/33; F21Y 2103/37; F21K 9/27; F21K 9/272; F21K 9/275; F21K 9/278
See application file for complete search history.

(56) References Cited

U.S. PATENT DOCUMENTS

| | | | |
|---|---|---|---|
| 7,067,032 | B1 | 6/2006 | Bremont et al. |
| 7,594,738 | B1 | 9/2009 | Lin et al. |

(Continued)

FOREIGN PATENT DOCUMENTS

| | | | |
|---|---|---|---|
| CN | 1292930 | A | 4/2001 |
| CN | 1460165 | A | 12/2003 |

(Continued)

*Primary Examiner* — Alexander K Garlen
(74) *Attorney, Agent, or Firm* — Muir Patent Law, PLLC

(57) ABSTRACT

A curved LED tubular lamp is disclosed. The curved LED tubular lamp includes a curved lamp tube having two straight segments and a curve segment disposed between the two straight segments; at least one flexible substrate having a plurality of LEDs mounted thereon, and at least one positioning pillar formed on the inner surface of the curve segment of the curved lamp tube, wherein each of the two straight segments and the curve segment have LEDs disposed therein, and wherein the flexible substrate is disposed in at least the curve segment.

20 Claims, 20 Drawing Sheets

(51) Int. Cl.

| | |
|---|---|
| ***F21V 17/10*** | (2006.01) |
| ***F21V 29/85*** | (2015.01) |
| ***F21V 15/015*** | (2006.01) |
| ***F21K 9/272*** | (2016.01) |
| ***F21V 3/06*** | (2018.01) |
| ***F21V 25/02*** | (2006.01) |
| ***F21Y 107/70*** | (2016.01) |
| ***F21Y 115/10*** | (2016.01) |
| ***F21Y 103/37*** | (2016.01) |
| ***F21Y 103/10*** | (2016.01) |

(52) U.S. Cl.
CPC ..... *F21Y 2103/37* (2016.08); *F21Y 2107/70* (2016.08); *F21Y 2115/10* (2016.08)

(56) References Cited

U.S. PATENT DOCUMENTS

| | | | |
|---|---|---|---|
| 8,240,875 | B2 | 8/2012 | Roberts et al. |
| 8,360,599 | B2 | 1/2013 | Ivey et al. |
| 8,456,075 | B2 | 6/2013 | Axelsson |
| 9,322,531 | B2 | 4/2016 | Liang et al. |
| 9,448,660 | B2 | 9/2016 | Seo et al. |
| 9,625,137 | B2 | 4/2017 | Li-Qin et al. |
| 9,864,438 | B2 | 1/2018 | Seo et al. |
| 2003/0189829 | A1 | 10/2003 | Shimizu et al. |
| 2004/0189218 | A1 | 9/2004 | Leong et al. |
| 2005/0162101 | A1 | 7/2005 | Leong et al. |
| 2005/0162850 | A1 | 7/2005 | Luk |
| 2005/0185396 | A1 | 8/2005 | Kutler |
| 2007/0001709 | A1 | 1/2007 | Shen |
| 2008/0055894 | A1 | 3/2008 | Deng et al. |
| 2008/0192476 | A1 | 8/2008 | Hiratsuka |
| 2008/0290814 | A1 | 11/2008 | Leong |
| 2009/0040415 | A1 | 2/2009 | Kim |
| 2009/0159919 | A1 | 6/2009 | Simon et al. |
| 2009/0219713 | A1 | 9/2009 | Siemiet et al. |
| 2010/0124054 | A1 | 5/2010 | Chen et al. |
| 2010/0201269 | A1 | 8/2010 | Tzou et al. |
| 2010/0220469 | A1 | 9/2010 | Ivey et al. |
| 2010/0253226 | A1 | 10/2010 | Oki |
| 2010/0277918 | A1 | 11/2010 | Chen et al. |
| 2011/0038146 | A1 | 2/2011 | Chen |
| 2011/0084627 | A1 | 4/2011 | Sloan et al. |
| 2011/0305021 | A1 | 12/2011 | Chang |
| 2012/0049684 | A1 | 3/2012 | Bodenstein et al. |
| 2012/0069556 | A1 | 3/2012 | Bertram et al. |
| 2012/0212951 | A1 | 8/2012 | Lai et al. |
| 2013/0021809 | A1 | 1/2013 | Dellian et al. |
| 2013/0033881 | A1 | 2/2013 | Terazawa et al. |
| 2013/0050998 | A1 | 2/2013 | Chu et al. |
| 2013/0051008 | A1 | 2/2013 | Shew |
| 2013/0135852 | A1 | 5/2013 | Chan et al. |
| 2013/0135857 | A1 | 5/2013 | Chen et al. |
| 2013/0215609 | A1 | 8/2013 | Liu et al. |
| 2013/0229104 | A1* | 9/2013 | Green ..... F21V 29/70 313/46 |
| 2013/0230995 | A1 | 9/2013 | Ivey et al. |
| 2013/0235570 | A1 | 9/2013 | Hood et al. |
| 2013/0250565 | A1 | 9/2013 | Chiang et al. |
| 2013/0258650 | A1 | 10/2013 | Sharrah |
| 2013/0293098 | A1 | 11/2013 | Li et al. |
| 2014/0009923 | A1 | 1/2014 | Wu et al. |
| 2014/0153231 | A1 | 6/2014 | Bittmann |
| 2014/0203717 | A1 | 7/2014 | Zhang |
| 2014/0225519 | A1 | 8/2014 | Yu et al. |
| 2014/0331532 | A1 | 11/2014 | Deppiesse |
| 2015/0070885 | A1 | 3/2015 | Petro et al. |
| 2015/0176770 | A1 | 6/2015 | Wilcox et al. |
| 2015/0345755 | A1 | 12/2015 | Purdy |
| 2016/0081147 | A1 | 3/2016 | Guang |
| 2017/0290119 | A1 | 10/2017 | Xiong et al. |

FOREIGN PATENT DOCUMENTS

| | | | |
|---|---|---|---|
| CN | 1914458 | A | 2/2007 |
| CN | 101092545 | A | 12/2007 |
| CN | 101182919 | A | 5/2008 |
| CN | 101228393 | A | 7/2008 |
| CN | 201255393 | Y | 6/2009 |
| CN | 201363601 | Y | 12/2009 |
| CN | 201437921 | U | 4/2010 |
| CN | 101787273 | A | 7/2010 |
| CN | 101806444 | A | 8/2010 |
| CN | 201555053 | U | 8/2010 |
| CN | 102016661 | A | 4/2011 |
| CN | 201866575 | U | 6/2011 |
| CN | 102121690 | A | 7/2011 |
| CN | 201954169 | U | 8/2011 |
| CN | 202100985 | U | 1/2012 |
| CN | 202120982 | U | 1/2012 |
| CN | 202216003 | U | 5/2012 |
| CN | 102518972 | A | 6/2012 |
| CN | 202281101 | U | 6/2012 |
| CN | 202392485 | U | 8/2012 |
| CN | 102720901 | A | 10/2012 |
| CN | 102738355 | A | 10/2012 |
| CN | 203068187 | U | 7/2013 |
| CN | 203131520 | U | 8/2013 |
| CN | 203162856 | U | 8/2013 |
| CN | 203240337 | U | 10/2013 |
| CN | 203240362 | U | 10/2013 |
| CN | 103411140 | A | 11/2013 |
| CN | 203464014 | U | 3/2014 |
| CN | 103742875 | A | 4/2014 |
| CN | 203517629 | U | 4/2014 |
| CN | 103822121 | A | 5/2014 |
| CN | 203615157 | U | 5/2014 |
| CN | 103851547 | A | 6/2014 |
| CN | 103943752 | A | 7/2014 |
| CN | 203686635 | U | 7/2014 |
| CN | 203771102 | U | 8/2014 |
| CN | 203927469 | U | 11/2014 |
| CN | 204083927 | U | 1/2015 |
| CN | 204300737 | U | 4/2015 |
| CN | 104595765 | A | 5/2015 |
| CN | 104832813 | A | 8/2015 |
| CN | 204573682 | U | 8/2015 |
| CN | 204573684 | U | 8/2015 |
| CN | 204573700 | U | 8/2015 |
| CN | 104033772 | B | 6/2016 |
| CN | 205877791 | U | 1/2017 |
| EP | 2554899 | A2 | 2/2013 |
| EP | 3146803 | A1 | 3/2017 |
| GB | 2523275 | A | 8/2015 |
| GB | 2531425 | A | 4/2016 |
| JP | 2013254667 | A | 12/2013 |
| KR | 20120055349 | A | 5/2012 |
| WO | 2009111098 | A2 | 9/2009 |
| WO | 2012129301 | A1 | 9/2012 |
| WO | 2014117435 | A1 | 8/2014 |

* cited by examiner

2 { 2A, 2B

CURVED LED TUBULAR LAMP

This application is a continuation application of U.S. patent application Ser. No. 15/441,592, filed on Feb. 24, 2017, the contents of which are incorporated herein by reference in their entirety, and which claims the benefit of priority under 35 U.S.C. 119 to Chinese Patent Application Nos.: CN 201610152885.6 filed on Mar. 17, 2016, CN 201620209317.0 filed on Mar. 18, 2016, CN 201610642281.X filed on Aug. 4, 2016, and CN 201610700677.5 filed on Aug. 19, 2016, the contents of each of which are incorporated herein by reference in their entirety.

BACKGROUND OF THE INVENTION

Field of the Invention

The present disclosure relates to a light emitting diode (LED) lamp and in particular relates to an LED tubular lamp having a curved body.

Description of the Related Art

Curved LED tubular lamps are widely used to replace conventional incandescent lamps in the market because of their advantages including long life-time, small size and power saving. All plastic tube is a common design in conventional curved LED tubular lamps, but it may suffer from poor heat dissipation. To address the above-mentioned shortcomings associated with conventional curved LED tubular lamps, a heat-dissipation housing made of a combination of aluminum alloy and plastic cover may be used, and the light source of the curved LED tubular lamp consisting of an LED array having a plurality of LEDs welded on a circuit board may be provided on the heat dissipation housing. As disclosed in FIG. 12 of U.S. patent publication no. 2015/0223301A1, the illustrated driver-less LED lighting device is a curved LED tubular lamp. Each of the two LED arrays 301 are provided on one of the two prongs. Each LED array 301 is provided on a PCB board 302, which itself is provided on top of the heat-sink 303 which also functions as a housing to the prong. Each prong also has a lens cover 304. There is one curved plastic connector 305a (top) and 305b (bottom) on one end to connect two prongs. There is a pin-socket assembly 306 that has two pairs of G13 bi-pin for inserting into the G-13 socket of a curved tube fixture. However, this kind of design may be prone to cause electrical shock because of conductive material, e.g., aluminum alloy, contained in the heat-dissipation housing and poor light transmittance of either the plastic cover or the plastic tube may also reduce the luminous efficiency. In addition, a dark zone (i.e., non-emitting segment having no LEDs disposed therein) may appear in the region of the plastic connector of the curved LED tubular lamp since there is no LED array disposed therein.

In addition, the light boards of the conventional curved LED tubular lamps are usually made of rigid printed circuit board (PCB), which is hard to be stretched. Therefore, a rigid board without an LED formed thereon or a wiring is placed in the connecting bar connecting two straight tube of the curved LED tubular lamp. This may result in a dark zone existing in the connecting bar of the curved LED tubular lamp. In addition, the heat dissipation rate of the rigid PCB is poor, so a heat sink structure placed outside the LED tubular lamp may be necessary. The additional heat sink will enhance the cost of the LED tubular lamp. Moreover, the rigid PCB or wire placed in the connecting bar may be easily shaken, moved, or broken due to lack of suitable positioning and guiding structures, which may affect the luminous efficiency of the curved LED tubular lamps. To address the above-mentioned shortcomings, the rigid PCBs may be replaced with flexible light boards to avoid the problem of a dark zone existing in the connecting bar of the curved LED tubular lamp. However, the flexible light board may be easily warped in the connecting bar of the curved LED tubular lamp, and the warpage may also affect the light efficiency of the LED tubular lamp. Therefore, to address the above-mentioned shortcomings associated with conventional curved LED tubular lamps, a novel curved LED tubular lamp is provided.

SUMMARY OF THE INVENTION

A feature of the present disclosure, according to exemplary embodiments, provides a curved LED tubular lamp, comprising: a curved lamp tube having two straight segments and a curve segment disposed between the two straight segments; at least one flexible substrate having a plurality of LEDs mounted thereon, and at least one positioning pillar formed on the inner surface of the curve segment of the curved lamp tube, wherein each of the two straight segments and the curve segment have LEDs disposed therein, and wherein the flexible substrate is disposed in at least the curve segment.

Another feature of the present disclosure, according to exemplary embodiments, provides a curved LED tubular lamp as mentioned above, wherein the flexible substrate is configured to be assembled and positioned by bending through the positioning pillars.

Another feature of the present disclosure, according to exemplary embodiments, provides a curved LED tubular lamp as mentioned above, wherein the flexible substrate comprises at least one positioning hole corresponding to the positioning pillar, and the flexible substrate is configured to be positioned by inserting the pillars into the corresponding positioning hole.

Another feature of the present disclosure, according to exemplary embodiments, provides a curved LED tubular lamp as mentioned above, wherein the curved LED tubular lamp includes two straight tubes and a rear supporter disposed between the two straight tubes, and the rear supporter has two installing parts at the end thereof for respectively joining one terminal of the straight tube; a connecting part having a straight shape and located between the two installing parts; and two transition parts having a curved shape, located between and connect the installing parts and the connecting part; wherein the installing part has at least one protruding rib for forming glue-coating space.

Another feature of the present disclosure, according to exemplary embodiments, provides a curved LED tubular lamp as mentioned above, wherein the rear supporter has a baffle board in the installing parts for positioning the straight tubes.

Another feature of the present disclosure, according to exemplary embodiments, provides a curved LED tubular lamp as mentioned above, wherein the rear supporter includes two pieces respectively having a buckle and a hook thereon.

Another feature of the present disclosure, according to exemplary embodiments, provides a curved LED tubular lamp as mentioned above, wherein the rear supporter has a plurality of rib boards formed in the connecting part and spaced from each other, each of the rib boards comprise a positioning groove corresponding to the width of the flexible substrate.

Another feature of the present disclosure, according to exemplary embodiments, provides a curved LED tubular lamp as mentioned above, wherein the rear supporter has a positioning protrusion extending from one side of the inner wall of the rear supporter and toward but keep a space from the other side of the inner wall of the rear supporter.

Another feature of the present disclosure, according to exemplary embodiments, provides a curved LED tubular lamp as mentioned above, wherein the curved LED tubular lamp further comprises one or two driving circuits, disposed in one or both of the straight segments of the curved LED tubular lamp.

Another feature of the present disclosure, according to exemplary embodiments, provides A curved LED tubular lamp, comprising: a curved lamp tube having two straight segments and a curve segment disposed between the two straight segments; and at least one flexible substrate having a plurality of LEDs mounted thereon, wherein each of the two straight segments and the curve segment have LEDs disposed therein, wherein the flexible substrate is disposed in at least the curve segment, and wherein the flexible substrate have a plurality of spacers to form notches thereon.

Another feature of the present disclosure, according to exemplary embodiments, provides a curved LED tubular lamp as mentioned above, wherein the flexible substrate has a fitting part attached on the inner wall of the curve segment of the curved lamp, and a placing part, including a plurality of placing pieces with at least one LED formed thereon installed.

Another feature of the present disclosure, according to exemplary embodiments, provides a curved LED tubular lamp as mentioned above, wherein the placing pieces and the spacers have the same shape.

Another feature of the present disclosure, according to exemplary embodiments, provides a curved LED tubular lamp as mentioned above, the flexible substrate further comprises a reflector extended from the fitting part or the placing piece to reflect the light emitted by at least one of the LEDs to enhance the luminance of the curved LED tubular lamp.

Another feature of the present disclosure, according to exemplary embodiments, provides a curved LED tubular lamp as mentioned above, the flexible substrate is configured to be separated into at least two segments.

Another feature of the present disclosure, according to exemplary embodiments, provides a curved LED tubular lamp as mentioned above, wherein the curved LED tubular lamp further comprises one or two driving circuits, disposed in one or both of the straight segments of the curved LED tubular lamp.

Another feature of the present disclosure, according to exemplary embodiments, provides a curved LED tubular lamp as mentioned above, wherein the curved LED tubular lamp includes two straight tubes and a rear supporter disposed between the two straight tubes, and the rear supporter includes two pieces respectively having a protruded edge and a trench extend along the edge thereof.

A feature of the present disclosure, according to exemplary embodiments, provides a curved LED tubular lamp, comprising: a curved lamp tube having two straight segments and a curve segment disposed between the two straight segments; at least one flexible substrate having a plurality of LEDs mounted thereon; a plurality of rib boards formed spaced from each other in the curve segment; wherein each of the two straight segments and the curve segment have LEDs installed therein, and wherein the flexible substrate is disposed in at least the curve segment.

Another feature of the present disclosure, according to exemplary embodiments, provides a curved LED tubular lamp as mentioned above, wherein the curved LED tubular lamp includes two straight tubes and a rear supporter disposed between the two straight tubes, the rear supporter has a plurality of rib boards formed in the connecting part and spaced from each other, each of the rib boards comprise a positioning groove corresponding to the width of the flexible substrate.

Another feature of the present disclosure, according to exemplary embodiments, provides a curved LED tubular lamp as mentioned above, wherein the rear supporter has a baffle board in the installing parts for positioning the straight tubes.

Another feature of the present disclosure, according to exemplary embodiments, provides a curved LED tubular lamp as mentioned above, wherein the rear supporter includes two pieces respectively having a buckle and a hook thereon.

Another feature of the present disclosure, according to exemplary embodiments, provides a curved LED tubular lamp as mentioned above, wherein the rear supporter has a positioning protrusion extending from one side of the inner wall of the rear supporter and toward but keep a space from the other side of the inner wall of the rear supporter.

Another feature of the present disclosure, according to exemplary embodiments, provides a curved LED tubular lamp as mentioned above, wherein the rear supporter has: two installing parts at the end thereof for respectively joining one terminal of the straight tube; a connecting part having a straight shape and located between the two installing parts; two transition parts having a curved shape, located between and connect the installing parts and the connecting part, and at least one positioning pillar formed within the transition parts.

Another feature of the present disclosure, according to exemplary embodiments, provides a curved LED tubular lamp as mentioned above, wherein the curved LED tubular lamp further comprises one or two driving circuits, disposed in one or both of the straight segments of the curved LED tubular lamp.

Another feature of the present disclosure, according to exemplary embodiments, provides a curved LED tubular lamp as mentioned above, wherein the curved LED tubular lamp further comprises two lamp casings each capped at the end of the straight tubes, wherein a pair of groove respectively formed on the two lamp casings.

DETAILED DESCRIPTION OF THE INVENTION

Figure 1:
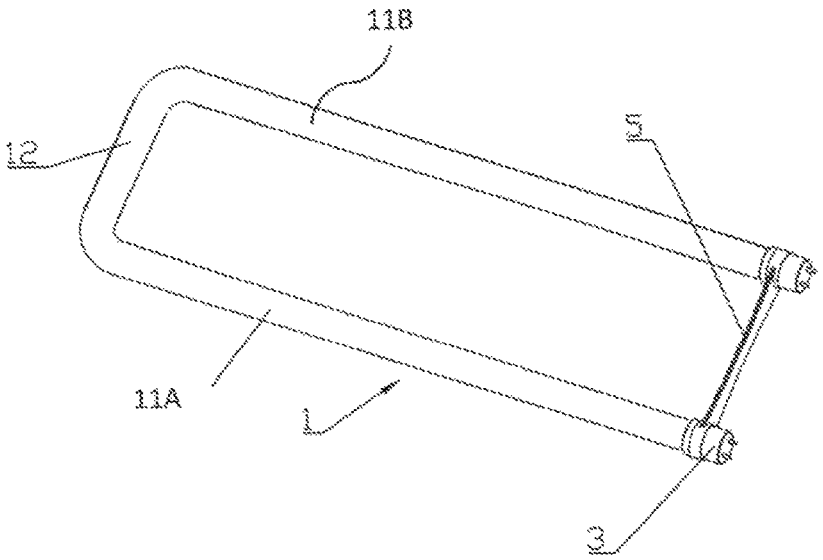
FIG. 1 is a perspective view of a curved LED tubular lamp according to embodiment 1 of the present disclosure.

The present disclosure now will be described more fully hereinafter with reference to the accompanying drawings, in which various embodiments are shown. The invention may, however, be embodied in many different forms and should not be construed as limited to the example embodiments set forth herein. These example embodiments are just that—examples—and many implementations and variations are possible that do not require the details provided herein. It should also be emphasized that the disclosure provides details of alternative examples, but such listing of alternatives is not exhaustive. Furthermore, any consistency of detail between various examples should not be interpreted as requiring such detail—it is impracticable to list every possible variation for every feature described herein. The language of the claims should be referenced in determining the requirements of the invention.

In the drawings, like numbers refer to like elements throughout. Though the different figures show various features of exemplary embodiments, these figures and their features are not necessarily intended to be mutually exclusive from each other. Rather, certain features depicted and described in a particular figure may also be implemented with embodiment(s) depicted in different figure(s), even if such a combination is not separately illustrated. Referencing such features/figures with different embodiment labels (e.g. "first embodiment") should not be interpreted as indicating certain features of one embodiment are mutually exclusive of and are not intended to be used with another embodiment.

Unless the context indicates otherwise, the terms first, second, third, etc., are used as labels to distinguish one element, component, region, layer or section from another element, component, region, layer or section (that may or may not be similar). Thus, a first element, component, region, layer or section discussed below in one section of the specification (or claim) may be referred to as a second element, component, region, layer or section in another section of the specification (or another claim).

Embodiments may be illustrated herein with idealized views (although relative sizes may be exaggerated for clarity). It will be appreciated that actual implementation may vary from these exemplary views depending on manufacturing technologies and/or tolerances. Therefore, descriptions of certain features using terms such as "same," "equal," and geometric descriptions such as "planar," "coplanar," "cylindrical," "square," etc., as used herein when referring to orientation, layout, location, shapes, sizes, amounts, or other measures, encompass acceptable variations from exact identically, including nearly identical layout, location, shapes, sizes, amounts, or other measures within acceptable variations that may occur, for example, due to manufacturing processes. The term "substantially" may be used herein to emphasize this meaning, unless the context or other statements indicate otherwise.

Unless otherwise defined, all terms (including technical and scientific terms) used herein have the same meaning as commonly understood by one of ordinary skill consistent with their meaning in the context of the relevant art and/or the present application.

Exemplary Embodiment 1

Figure 2:
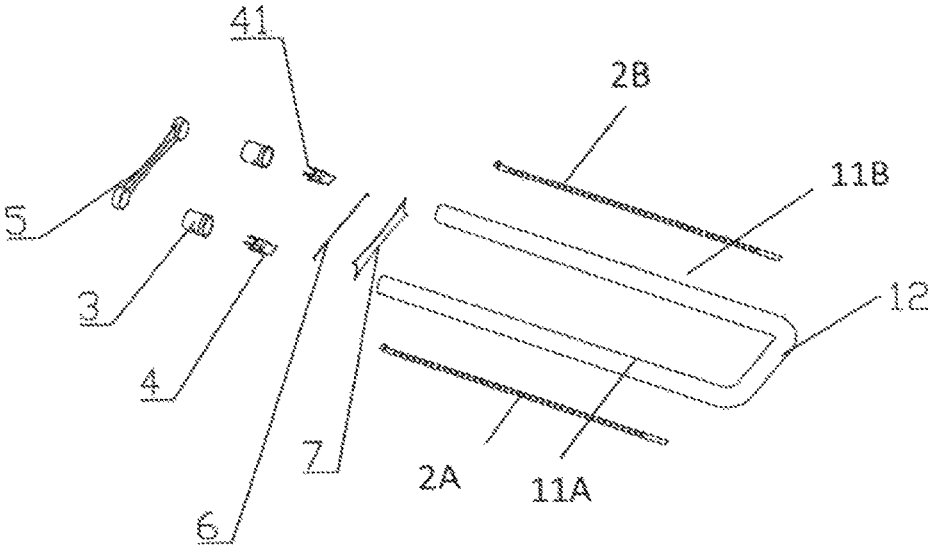
FIG. 2 is an exploded view of the curved LED tubular lamp as illustrated in FIG. 1.

A curved LED tubular lamp of the embodiment 1 of the present disclosure is illustrated in FIGS. 1 to 2. The curved LED tubular lamp comprises a lamp tube 1, an LED light board 2, a lamp cap 3, and a driving circuit 4.

The curved lamp tube 1 of this embodiment is an integrated glass tube comprising two straight tubes 11A, 11B, and a rear supporter 12, wherein the rear supporter 12 is located between the straight tubes 11A and 11B and integrated with the straight tubes 11A and 11B to form a curved lamp tube 1 as shown in FIG. 1. The heat dissipation property of the glass tube of this embodiment is better than that of the plastic light tube, so the heat generated by the LEDs formed on the LED light board 2 can be efficiently dissipated into air through the glass tube. Accordingly, the luminous efficiency of the curved LED tubular lamp can be highly enhanced. In addition, compared to conventional curved lamp tubes, the curved lamp tube 1 made of an integrated glass tube may be manufactured easily and may be more attractive and durable.

The LED light board 2 with a plurality of LEDs formed thereon comprises a first light bar 2A and a second light bar 2B, wherein the first light bar 2A and the second light bar 2B are respectively attached on the inner wall of straight tubes 11A and 11B by means of a glue such as silicone or other glues with a function of good heat dissipation, or a linear silicone tape. According to other embodiments of the present disclosure, the curved LED tubular lamp can further comprise a middle connecting segment (not shown) with a plurality of LEDs formed thereon, wherein the middle connecting segment (not shown) is interconnected to the first light bar 2A and the second light bar 2B and installed in the rear supporter 12 to generate a curved LED tubular lamp without a dark zone. In some embodiments, the first light bar 2A, the second light bar 2B and the middle connecting segment (not shown) are flexible boards, e.g., flexible substrate, with a plurality of LEDs formed thereon. For example, in certain embodiments, the first light bar 2A, the second light bar 2B and the middle connecting segment (not shown) may be formed from a flexible substrate, e.g., a bendable circuit sheet, a bendable circuit board, or a flexible or non-rigid tape or ribbon.

Figure 4:
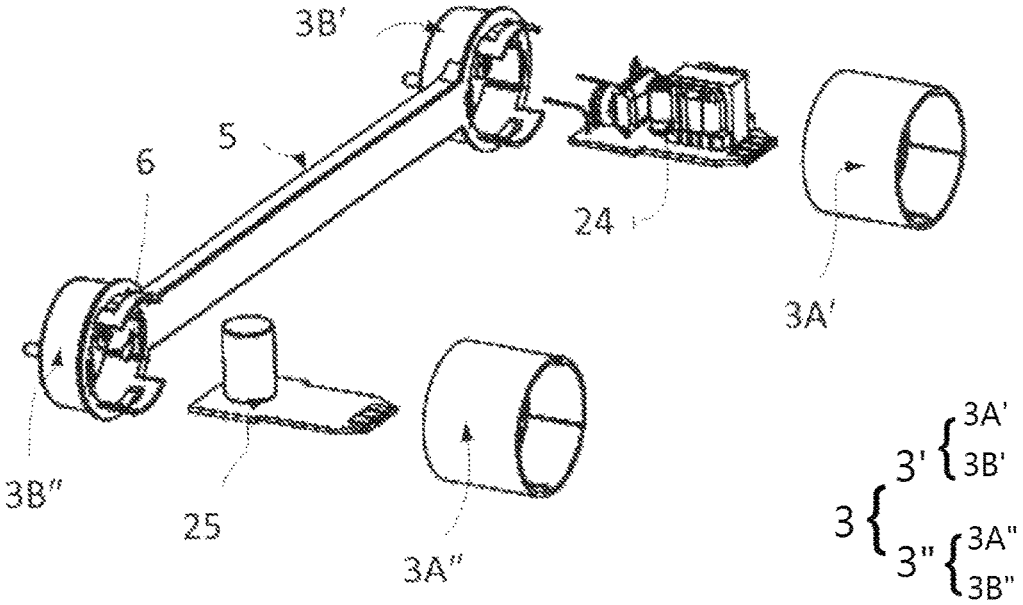
FIG. 4 is a perspective view of a structure, which is capable of being used in the curved LED tubular lamp of the embodiment 1, assembled as a whole by the first front supporter and the lamp caps of the embodiment 1 of the present disclosure.

As shown in FIGS. 1-2, the lamp caps 3 are capped on the front terminals of straight tubes 11A and 11B, and a driving circuit 4 is encapsulated inside the lamp cap 3, wherein one end of the driving circuit 4 is a metal pin 41 protruding out of the lamp cap 3, and the other end of the driving circuit 4 is interconnected to the LED light board 2 by welding or plugging. The driving circuit 4 of other embodiments of the present disclosure can also be formed on the LED light board 2 instead of being encapsulated inside the lamp cap 3, and the metal pin 41 of the driving circuit 4 is fastened on the LED light board 2. The driving circuits 4 may be disposed in both of the two lamp caps 3 as shown in FIG. 2, or may be only disposed in one of the two lamp caps 3, as shown in FIG. 4.

As shown in FIGS. 1-2, a first front supporter 5 can be further formed between those two lamp caps 3 to enhance the stability of the whole curved LED tubular lamp. The lamp caps 3 and the first front supporter 5 can be integrated as a whole as shown in FIGS. 1-2 or assembled as a whole.

As shown in FIGS. 1-2, the driving circuits 4 are interconnected by a conductive connector 6 like a wire. The two driving circuits 4 may share the power supply of the curved LED tubular lamp which may prevent the driving circuit from being overheated. Moreover, the first front supporter 5 further comprises a second front supporter 7, and the conductive connector 6 is sandwiched between the first front supporter 5 and the second front supporter 7 to avoid electric shock caused by the exposed conductive connector 6.

Figure 3:
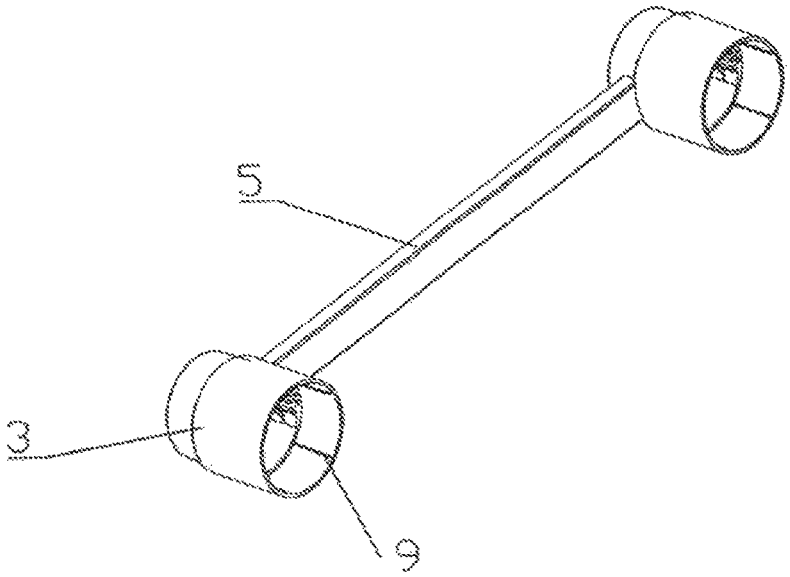
FIG. 3 is a perspective view of a structure, which is capable of being used in the curved LED tubular lamp of the embodiment 1, integrated as a whole by the first front supporter and the lamp caps of the embodiment 1 of the present disclosure.

As shown in FIG. 3, certain ribs 9 are formed on the inner side of the casing 3A of each of the lamp caps 3 to provide a glue with a uniform thickness when the lamp caps 3 are capped on the terminals of the straight tubes 11A or 11B through the casing 3A, and the glue with a uniform thickness can avoid the presence of inconsistent slits caused by the gravity during aging period.

In other embodiments, as shown in FIG. 4, the lamp caps 3 and the first front supporter 5 are assembled as a whole, wherein the lamp caps 3 comprises a first lamp cap 3' with a first lamp casing 3A' and a first lamp cover 3B', and a second lamp cap 3" with a second lamp casing 3A" and a second lamp cover 3B". The first front supporter 5 is set forth between the first lamp cover 3B' and the second lamp cover 3B". The first lamp casing 3A' and the second lamp casing 3A" are separated from the first lamp cover 3B' and the second lamp cover 3B" on the first front supporter 5 before being assembled, and the conductive connector 6 is encapsulated inside the first front supporter 5. Two ends of the conductive connector 6 are extended outside the first front supporter 5. The power module 24 and a capacitor 25 are separately welded to two ends of the conductive connector 6 first, and are respectively inserted into the first lamp casing 3A' and the second lamp casing 3A". Then the first lamp casing 3A' with the power module 24 inside and the second lamp casing 3A" with the capacitor 25 inside are respectively attached to the first lamp cover 3B' and the second lamp cover 3B" on the first front supporter 5 to be assembled as a whole. A plurality of ribs can be formed on the inner sides of the first lamp cover 3B and the second lamp cover 3B" as shown in FIG. 3, and details of ribs will not be discussed here. As described formerly, in some embodiments, the capacitor 25 in FIG. 4 could be replaced by another driving circuit 4 for preventing overheat.

Figure 5:
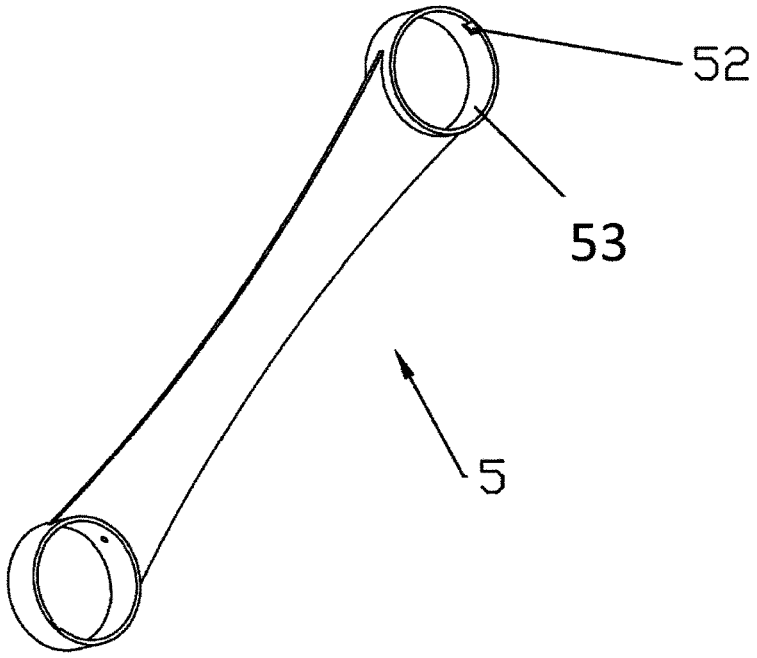
FIG. 5 is a perspective view of a front supporter which is capable of being applied in the structure as illustrated in FIG. 4.
Figure 6:
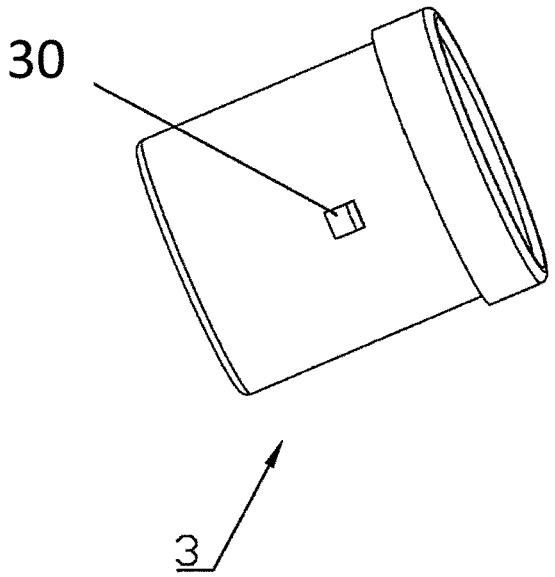
FIG. 6 is a perspective view of a lamp cap which can be assembled as whole with the first front supporter as illustrated in FIG. 5.

Furthermore, among other embodiments whose first front supporter 5 and the lamp caps 3 are assembled as a whole, as shown in FIGS. 5-6, the first front supporter 5 further comprises two separated collars 53 corresponding to those two lamp caps 3, wherein each lamp cap 3 and each collar 53 can be assembled by means of a positioning trench 52 formed inside of each collar 53 and a positioning protrusion 30.

Figure 7:
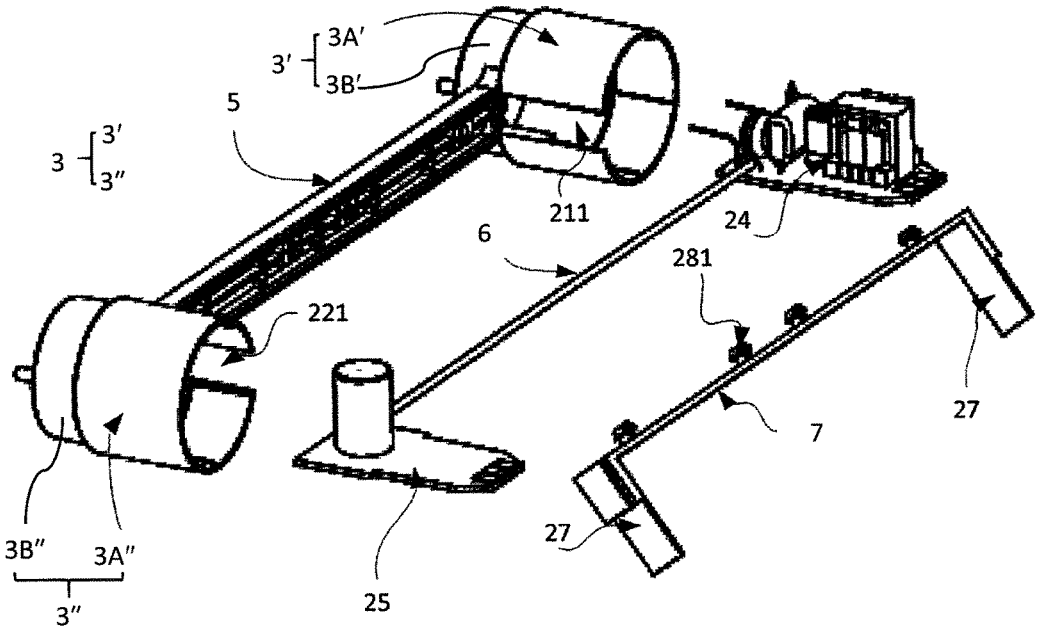
FIG. 7 is an exploded view of a structure integrated as a whole by the first front supporter and the lamp caps.

As mentioned above, the lamp caps 3 and the first front supporter 5 can also be integrated as a whole. FIG. 7 illustrates another embodiment whose lamp caps 3 and the first front supporter 5 are integrated as a whole, wherein the lamp caps 3 comprises a first lamp cap 3' with a first lamp casing 3A' and a first lamp cover 3B', and a second lamp cap 3" with a second lamp casing 3A" and a second lamp cover 3B", and the first front supporter 5 is provided between the first lamp cover 3B' and the second lamp cover 3B" Each of front terminals of the first lamp cover 3B' and the second lamp cover 3B" comprises a pin for plugging on lamp bases (not shown) to interconnect to a power source, and the rear terminal of the first lamp casing 3A' is capped in or on the terminal (not labeled) of the straight tube 11A, and the rear terminal of the second lamp casing 3A" is capped in or on the end (not labeled) of the straight tube 11B. As shown in FIG. 7, the power module comprises the power module 24 encapsulated in the first lamp cap 3', and the capacitor 25 encapsulated in the second lamp cap 3", wherein the power module 24 and the capacitor 25 are interconnected by a conductive connector 6. The conductive connector 6 may be shield by the first front supporter 5 to avoid electric shock caused by the exposure. Furthermore, grooves 211 and 221 may be respectively formed on the first lamp casing 3A' and the second lamp casing 3A" to facilitate the installation of the power modules 24 and the capacitor 25, wherein grooves 211 and 221 have openings facing the terminals of the straight tubes 11A and 11B. The power module 24 and the capacitor 25 interconnected by the conductive connector 6 are installed to the first lamp cap 3' and the second lamp cap 3" through the aid of grooves 211 and 221, and the conductive connector 6 may be pulled into the grooves 211 and 221 through the openings thereof. According to the exemplary design as described above, the conductive connector 6 can be moved together with the power module 24 and the capacitor 25, and interconnected with the first power module 24 and the capacitor 25 before installation, which can facilitate the installation of power modules.

As shown in FIG. 7, two tenons 27 may be disposed on grooves 211 and 221 respectively to avoid the exposure of the conductive connector 6, the power module 24 and the capacitor 25, wherein a second front supporter 7 may be formed between the two tenons 27, and the conductive connector 6 may be sandwiched between the first front supporter 5 and the second front supporter 7. The tenons 27 are used to block the grooves 211 and 221, and integrated or assembled as a whole with the second front supporter 7 to form a curved structure. The first front supporter 5 and the second front supporter 7 are detachably joined. In this exemplary embodiment, the first front supporter 5 and the second front supporter 7 are joined by the plug-in mechanism. As shown in FIG. 7, the first front supporter 5 and the second front supporter 7 are joined by plugging each of the protrusions 281 formed on the second front supporter 7 into each of the sockets (not labeled) formed on the longitudinal axis of the first front supporter 5. The protrusions 281 can also be formed on the first front supporter 5, and the sockets can also be formed on the second front supporter 7. As shown in FIG. 7, the lamp cap 3 and the first front supporter 5 may be integrated as a whole, and therefore, may stabilize the structure of the curved LED tubular lamp as well as simplify the manufacturing processes, facilitate assembly and reduce the manufacturing cost.

Figure 8:
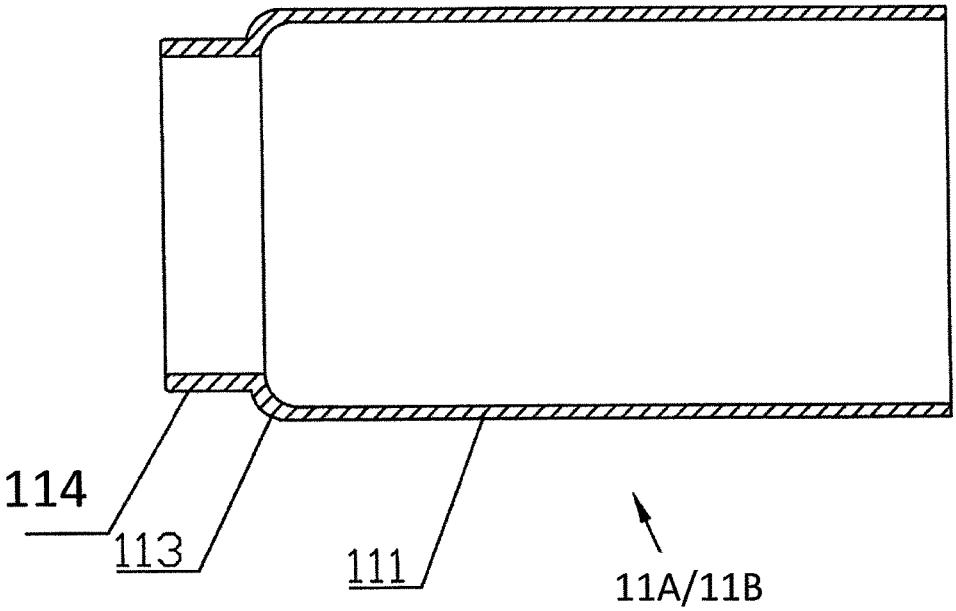
FIG. 8 is a side view of the end terminal of a straight tube of the curved lamp of the embodiment 1 of the present disclosure.

Furthermore, as shown in FIG. 8, each of straight tubes 11A and 11B comprises a tube body 111 with at least one terminal 114 having an outside diameter smaller than that of the tube body 111 for installing the lamp cap 3. In this exemplary embodiment, the outer diameter of the lamp cap 3 gradually decreasing to approach or even equal to the outer diameter of the tube body 111 can ensure the packing materials to not only contact to the lamp caps 3 but also the straight tubes 11A and 11B to avoid breakage caused by the stress concentrated on the lamp caps 3 and the terminals 114. Accordingly, curved LED tubular lamps with high yield rate and attractive appearance can be generated. Moreover, an arc angle part 113 with a curved surface can be further provided to be located between the tube body 111 and the terminal 114, and the straight tubes 11A and 11B can be further covered by a transparent film (not shown) to secure the straight tubes 11A and 11B not to be broken into pieces when struck or when dropped. A transparent film with different transmittance can be chosen to provide a curved LED tubular lamp with desired illumination. In addition, an insulating glue (not shown) can be coated on the LED light board 2 to avoid electronic shock when the lamp tube 1 is broken.

Exemplary Embodiment 2

Figure 9:
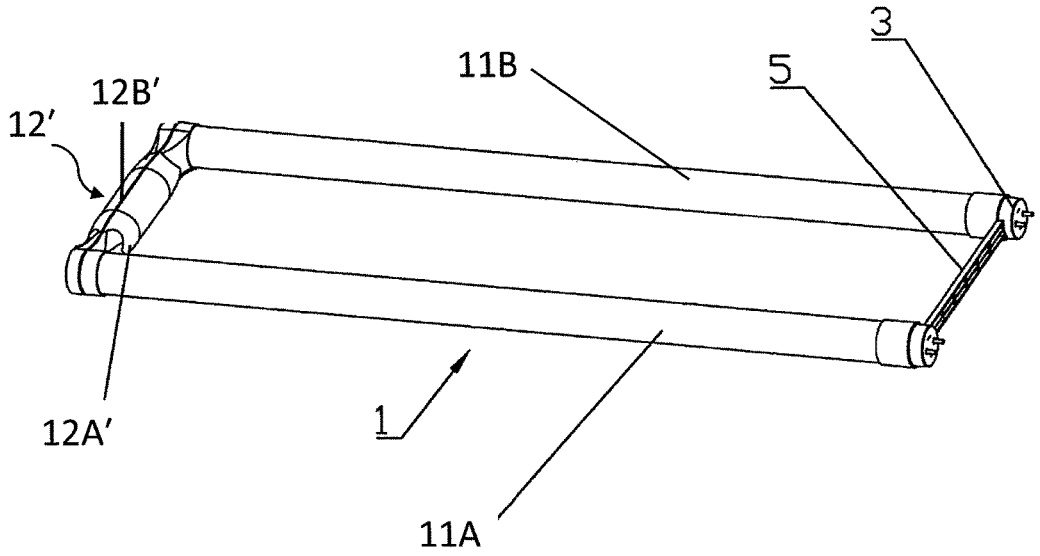
FIG. 9 is a perspective view of a curved LED tubular lamp according to embodiment 2 of the present disclosure.
Figure 10:
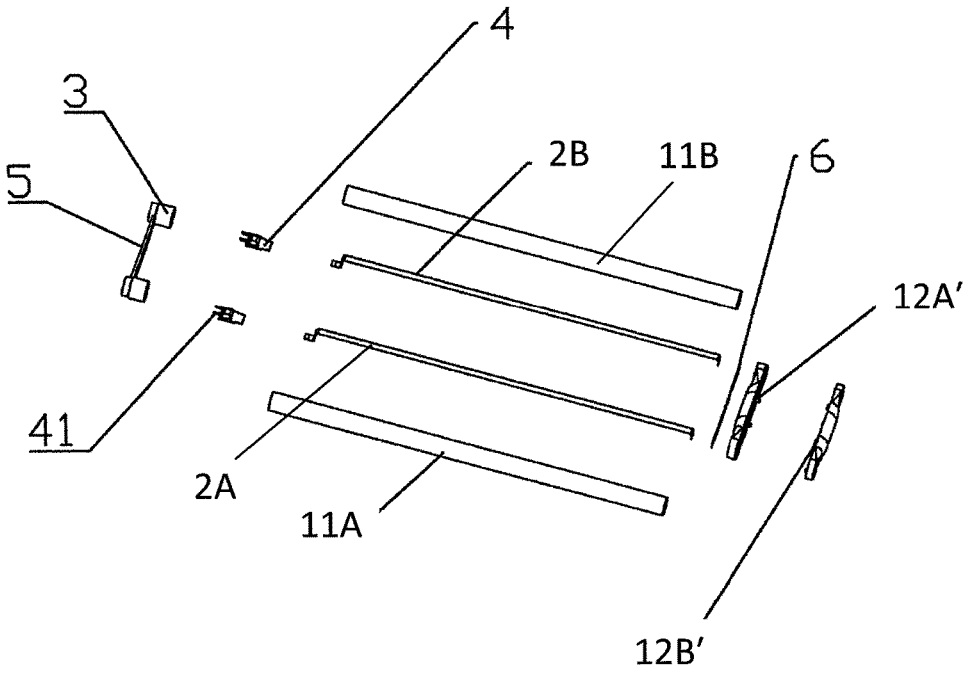
FIG. 10 is an exploded view of the curved LED tubular lamp as illustrated in FIG. 9.

As illustrated in FIGS. 9-10, the curved LED tubular lamp of this embodiment is similar to the curved lamp of embodiment 1 mentioned above, which comprises a lamp tube 1, an LED light board 2, lamp caps 3 and driving circuits 4. However, the lamp tube 1 of this embodiment is assembled as a whole by two straight tubes 11A and 11B, and a rear supporter 12' therebetween, wherein the rear supporter 12' is made of a plastic with relatively good transmittance. As for the lamp caps 3, they can be integrated as a whole or assembled as a whole with the first front supporter 5 as mentioned above. However, the lamp caps 3 shown in FIG. 10 are integrated as a whole with the supporter 5, and the lamp caps 3 can also be assembled as a whole with the supporter 5 in the other embodiments.

As shown in FIGS. 9-10, the end of the LED light board 2 is electrically connected to the conductive connector 6 to interconnect the driving circuits on two sides of the LED light board 2, wherein a wire or an LED light board can be selected as the conductive connector 6. Furthermore, the rear supporter 12' comprises a first rear supporter 12A' and a second rear supporter 12B', and the normal lines (e.g., perpendicular lines) to the first rear supporter 12A' and the second rear supporter 12B' are parallel to the longitudinal axes of the straight tubes 11A and 11B. The conductive connector 6 is sandwiched and may be hidden between the first rear supporter 12A' and the second rear supporter 12B' to avoid electronic shock caused by the exposure of the conductive connector 6. The conductive connector 6 can also be placed between the driving circuits 4 as mentioned in embodiment 1, and the rear supporter 12' is used to join the straight tubes 11A and 11B.

Figure 11:
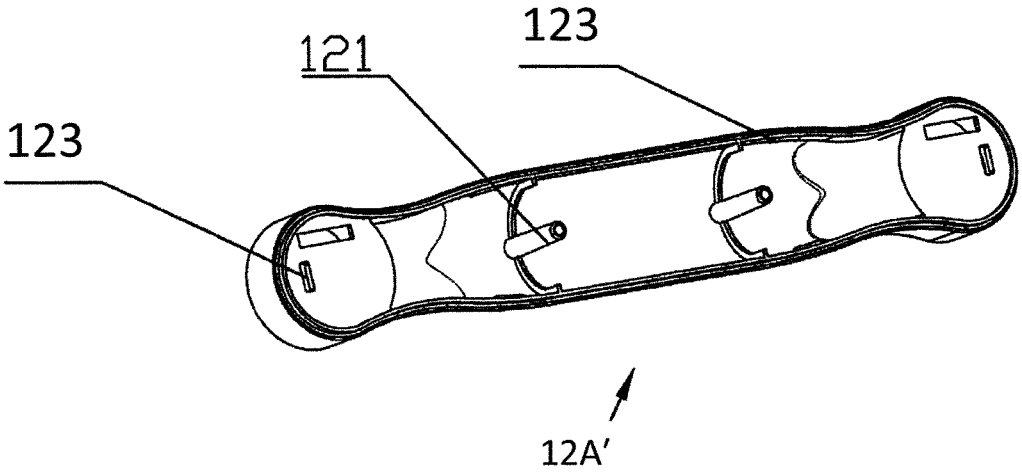
FIG. 11 is a perspective view of the first rear supporter which is capable of being applied in the curved LED tubular lamp of the embodiment 2 of the present disclosure.
Figure 12:
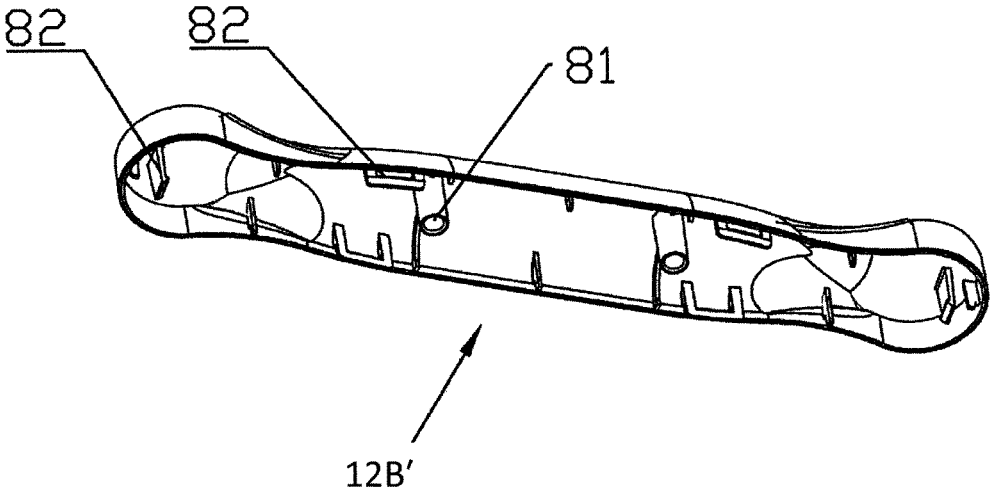
FIG. 12 is a perspective view of the second rear supporter corresponding to the first rear supporter as illustrated in FIG. 11.

In this exemplary embodiment, the conductive connector 6 is a flexible printed circuit board (FPC) joined with the LED light board 2 by welding. When an LED light board is selected as the connector 6 to generate a curved LED tubular lamp without a dark zone, a FPC with a plurality of LEDs is formed thereon according to an exemplary embodiment. For example, the first light bar 2A, the second light bar 2B and the connector 6 are flexible boards with a plurality of LEDs formed thereon. To secure the FPC, the first rear supporter 12A' and the second rear supporter 12B' are designed as illustrated in FIGS. 11-12. The first rear supporter 12A' comprises two first positioning pillars 121, and the second rear supporter 12B' comprises two second positioning pillars 81 corresponding to each of the first positioning pillars 121. The FPC comprises two positioning holes (not shown) corresponding to each of the positioning pillars 121, and the FPC can be accurately positioned by inserting the pillars 121 into the corresponding positioning holes (not shown), and the second rear supporter 12B' is assembled as a rear supporter 12' with the first rear supporter 12A' by capping the second positioning pillars 81 on the first positioning pillars 121. In some embodiments, the positioning pillars may be column-shaped or cone-shaped in cross-section. In some embodiments, the positioning pillars may have a shape that protrudes outward.

In addition, the assembly of the first rear supporter 12A' and the second rear supporter 12B' can be attached by the hooks 123 formed on two opposite sides and edge of the first rear supporter 12A' and the buckles 82 corresponding to the hooks 123 formed on the second rear supporter 12B'.

Furthermore, the first rear supporter 12A' and the second rear supporter 12B' can be made of transparent materials for light to transmit out of the rear supporter 12' when the conductive connector 6 is a FPC with LEDs formed thereon.

Figure 13:
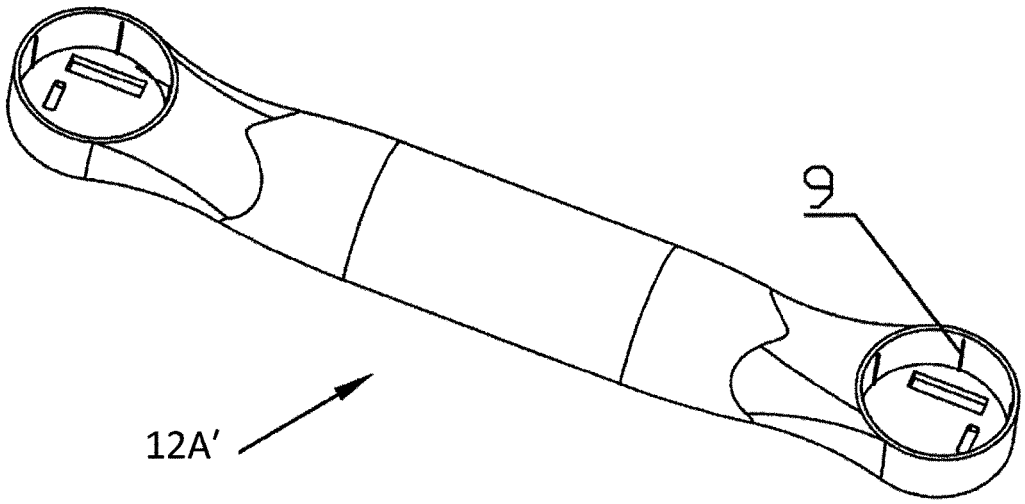
FIG. 13 is a perspective view of the first rear supporter viewed in another angle which is capable of being applied in the curved LED tubular lamp of the embodiment 2 of the present disclosure.

Moreover, as shown in FIG. 13, the inner of the first rear supporter 12A' can further comprise certain ribs 9 as those formed on the inner of the lamp caps 3 shown in FIG. 3 to provide a glue with a uniform thickness when the first rear supporter 12A' is joined with the straight tubes 11A or 11B to avoid the presence of inconsistent slits caused by the gravity during aging period.

Exemplary Embodiment 3

Figure 14:
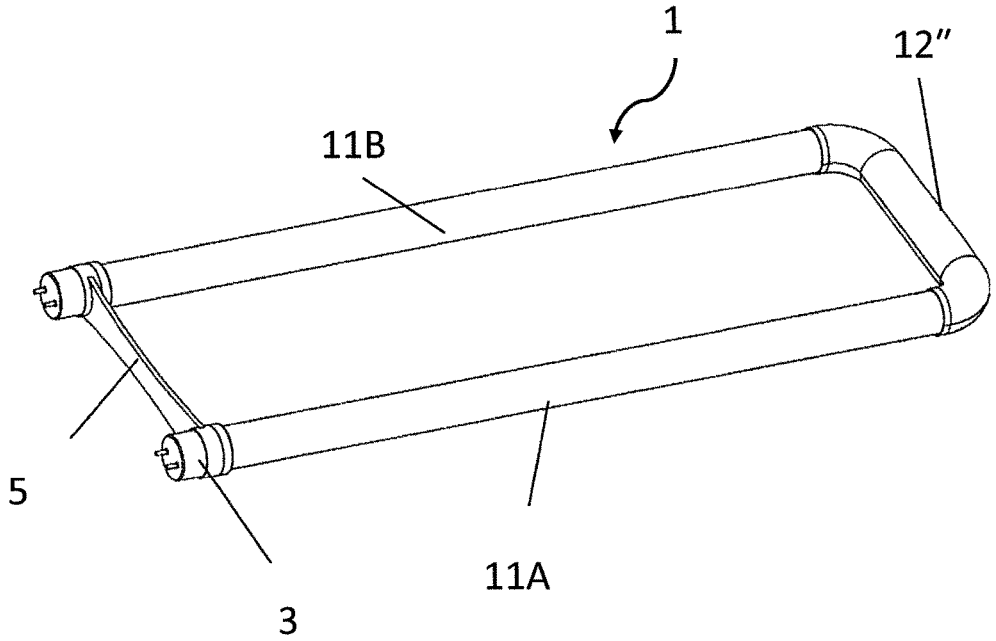
FIG. 14 is a perspective view of a curved LED tubular lamp according to embodiment 3 of the present disclosure.
Figure 15:
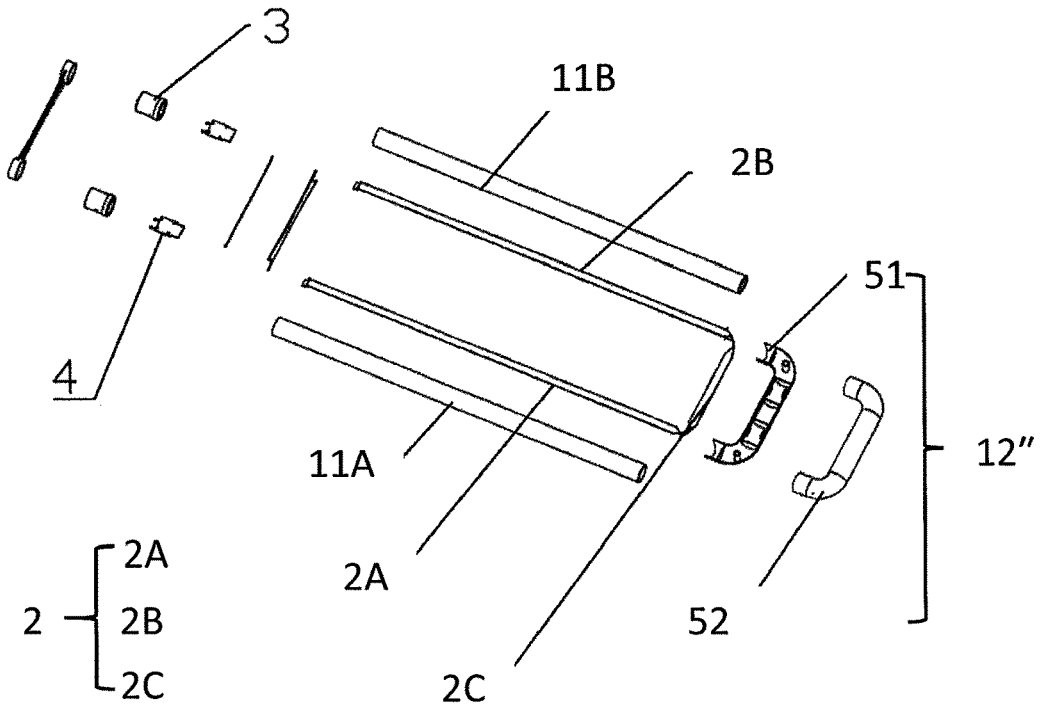
FIG. 15 is an exploded view of the curved LED tubular lamp as illustrated in FIG. 14.

As illustrated in FIGS. 14-15, the curved LED tubular lamp of this embodiment is similar to the curved lamp of embodiment 2 mentioned above, which comprises a lamp tube 1, an LED light board 2, lamp caps 3 and driving circuits 4. However, the lamp tube 1 of this embodiment is assembled as a whole by two straight tubes 11A and 11B, and a rear supporter 12" therebetween, wherein the rear supporter 12" may be made of a plastic with good transmittance characteristics and is not formed by integrating the straight tubes 11A and 11B as a whole. As for the lamp caps 3, they can be integrated as a whole or assembled as a whole with the first front supporter 5 as mentioned above. However, the lamp caps 3 shown in FIGS. 14-15 are assembled as a whole with the supporter 5, and the lamp caps 3 can also be integrated as a whole with the supporter 5 in other embodiments.

Figure 17:
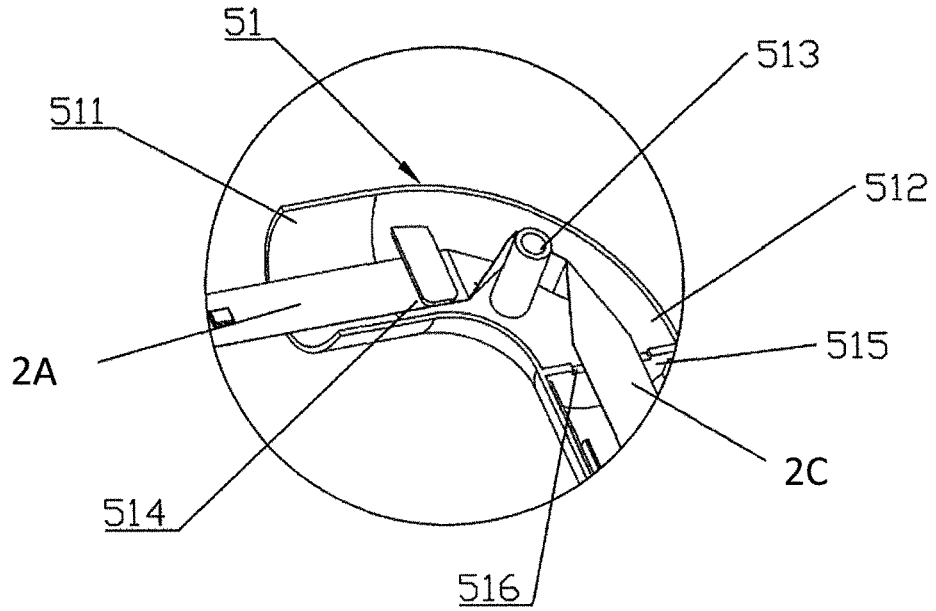
FIG. 17 is an enlarged perspective view of the first curved part of the curved LED tubular lamp as illustrated in FIG. 14.
Figure 18:
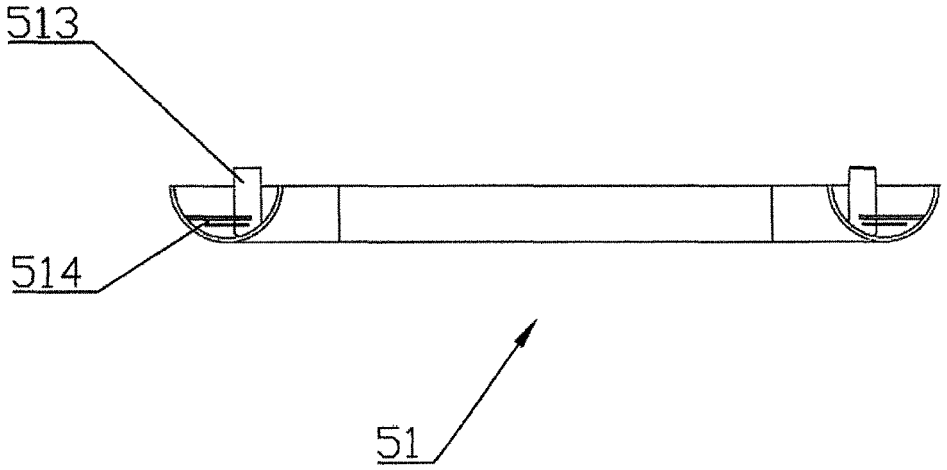
FIG. 18 is a front view of the first curved part of the curved LED tubular lamp as illustrated in FIG. 14.

As shown in FIGS. 15 and 17, the rear supporter 12" comprises a first curved part 51 and a second curved part 52, and the normal lines to the first curved part 51 and the second curved part 52 are perpendicular to the longitudinal axes of the straight tubes 11A and 11B. The first curved part 51 comprises a pair of first installing part 511 for respectively joining one terminal of the straight tube 11A, 11B; a first connecting part 512 extending straight between the two first installing parts 511, and a pair of first transition part 518 formed between the first connecting part 512 and the first installing parts 511 and have a curved-shape, wherein at least one positioning pillar(s) 513 may be formed in the first transition parts 518. The LED light board 2 may be a FPC with a plurality of LED formed thereon. As shown in FIG. 15, the LED light board 2 comprises a first light bar 2A installed primarily in the first straight tube 11A, a second light bar 2B installed primarily in the second straight tube 11B and a middle connecting segment 2C interconnected therebetween and installed in the rear supporter 12". In this exemplary embodiment, the first light bar 2A, the second light bar 2B and the middle connecting segment 2C are flexible boards with a plurality of LEDs formed thereon to generate a curved LED tubular without a dark zone. The LED light board 2 can be accurately assembled and positioned by bending 90 degrees through the positioning pillars 513.

As shown in FIGS. 16-20, two positioning protrusions 514 horizontally spaced apart from each other are formed within the first transition parts 518. The space between those two positioning protrusions 514 corresponds to the thickness of the LED light board 2 to ensure the LED light board 2 to be tightly clamped between those two positioning protrusions 514, which may position the LED light board 2 accurately and avoid twisting of the LED light board 2 due to bending 90 degrees through the positioning pillars 513. Furthermore, a plurality of first rib boards 515 are formed on the first connecting part 512 and spaced from each other. The first rib boards 515 further comprise positioning grooves 516 corresponding to the LED light board 2 to enhance the strength of the first curved part 51, and guide and attach the middle connecting segment 2C of the LED light board 2.

Figure 19:
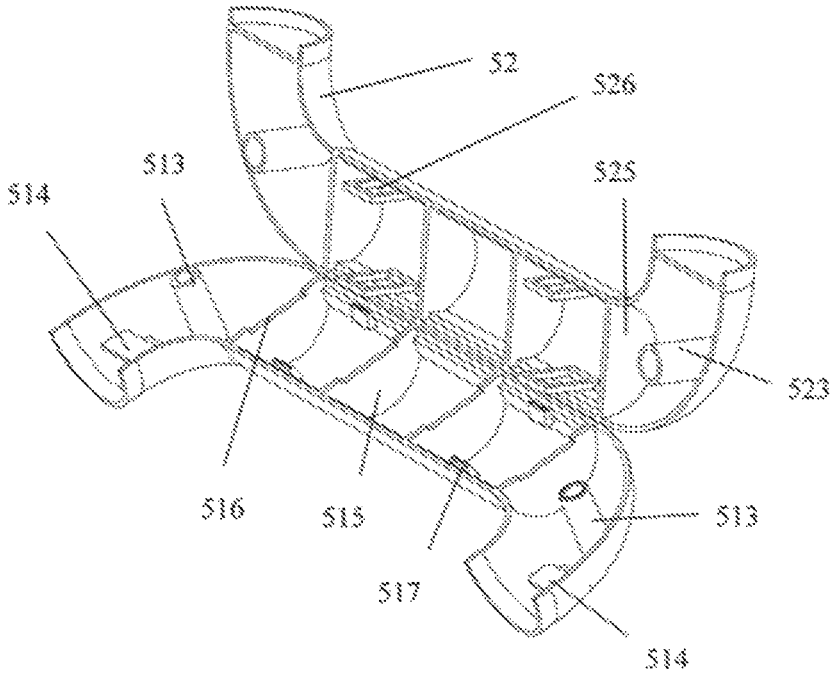
FIG. 19 is a perspective view of the first curved part and the second curved of the curved LED tubular lamp as illustrated in FIG. 14 before being assembled as a whole.
Figure 21:
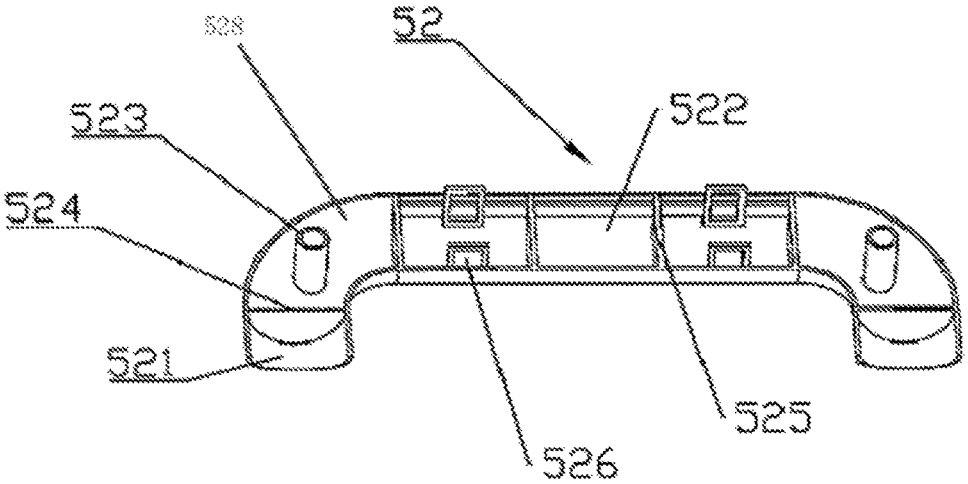
FIG. 21 is a perspective view of the second curved part as illustrated in FIG. 14 after removing the second curved part.

As shown in FIGS. 19 and 21, the second curved part 52 comprises a pair of second installing parts 521 for joining one terminal of the straight tube 11B; a second connecting part 522 extending straight between the two second installing parts 521, and a pair of second transition part 528 formed between the second installing parts 521 and the second connecting part 522. Wherein at least one positioning cap(s) 523 corresponding to the positioning pillars 513 may be formed in the second transition parts 528. The second curved part 52 is positioned by capping the positioning caps 523 to the positioning pillars 513. Furthermore, a plurality of second rib boards 525 are formed on the second connecting part 522 and spaced from each other. The second rib boards 525 corresponding to the first rib boards 515 and fix/press the middle connecting segment 2C of the LED light board 2. The second rib boards 525 can enhance the strength of the second curved part 52. The middle connecting segment 2C of the LED light board 2 can be tightly clamped between the first rib board 515 and the second rib board 525 to ensure the position of the LED light board 2. The installing part (not labeled) of the rear supporter 12" comprises a first installing part 511 and a second installing part 521, and the connecting part (not labeled) of the rear supporter 12" comprises a first connecting part 512 and a second connecting part 522, and a curved part (not labeled) with positioning pillars 513/positioning caps 523 may be located between the installing part (not labeled) and the connecting part (not labeled).

Figure 16:
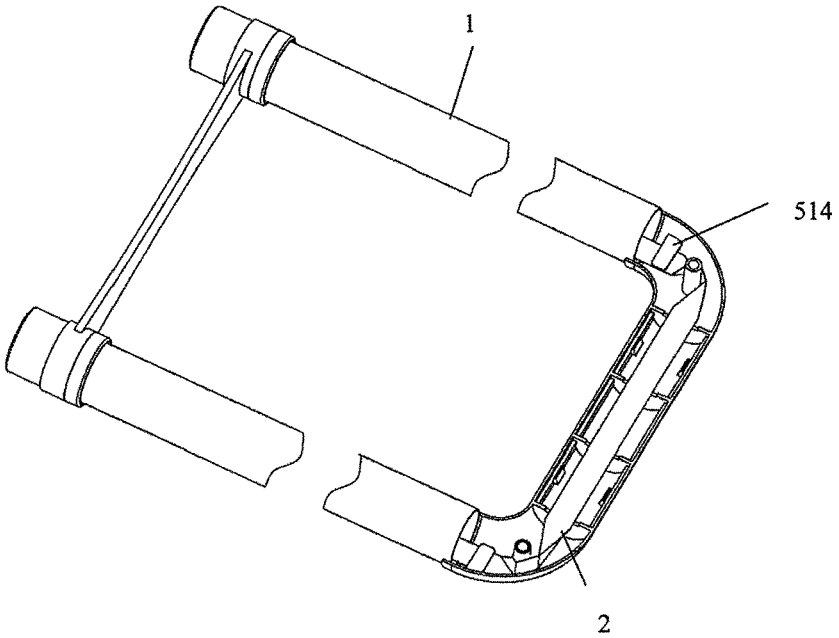
FIG. 16 is a partial perspective view of the curved LED tubular lamp as illustrated in FIG. 14 after removing the second curved part.

As shown in FIGS. 16-17, the LED light board 2 in the installing part (not labeled) and the connecting part (not labeled) is horizontally extended along the same longitudinal axes of the first, second light bars 2A, 2B, and the LED light board 2 in the curved is vertically extended after fastened by the rear supporter 12". Because the curved part is shorter than the installing part and the connecting part, the LED light board 2 are almost horizontally extended. Accordingly, the illumination uniformity of the curved LED tubular lamp can be highly improved.

Moreover, a position board (i.e., baffle board) 524 can further be formed on the second installing part 521 of the second curved part 52 to restrict the light tube 1 along a desired direction to facilitate following assembly.

Figure 20:
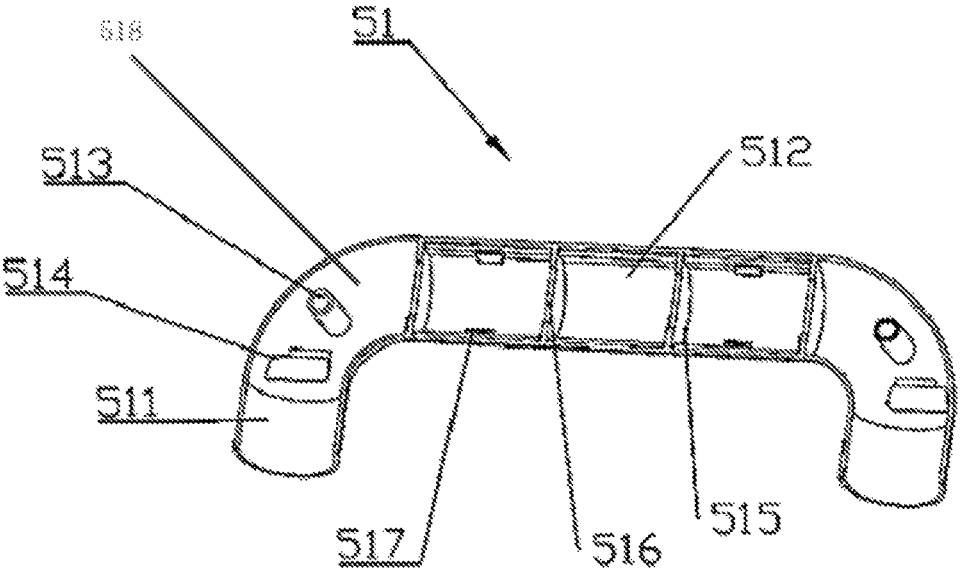
FIG. 20 is a perspective view of the first curved part as illustrated in FIG. 14 after removing the second curved part.

As shown in FIGS. 19-21, the assembly of the first curved part 51 and the second curved part 52 can be secure by further forming two additional hooks 517 on two opposite sides of the first connecting part 512 of the first curved part 51, and two additional buckles 526 corresponding to the hooks 517 formed on two opposite sides of the second connecting part 522 of the second curved part 52. The number of hooks and buckles is not limited to two, it can also be one, three, or more.

Exemplary Embodiment 4

Figure 22:
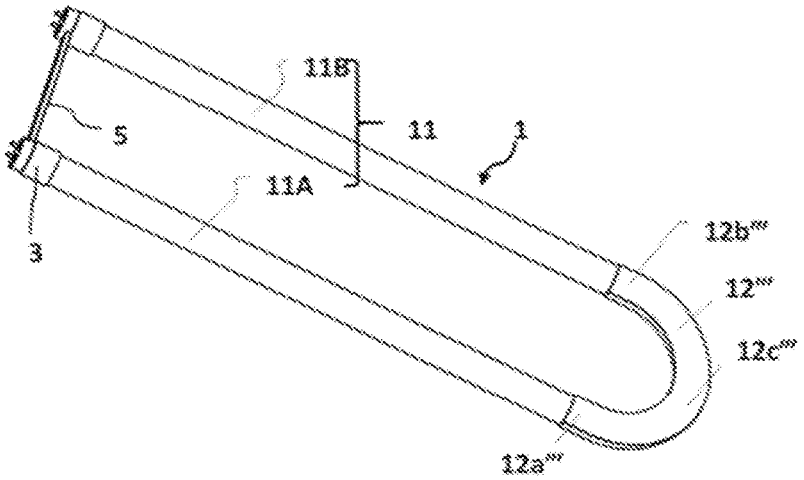
FIG. 22 is a perspective view of a curved LED tubular lamp according to embodiment 4 of the present disclosure.
Figure 23:
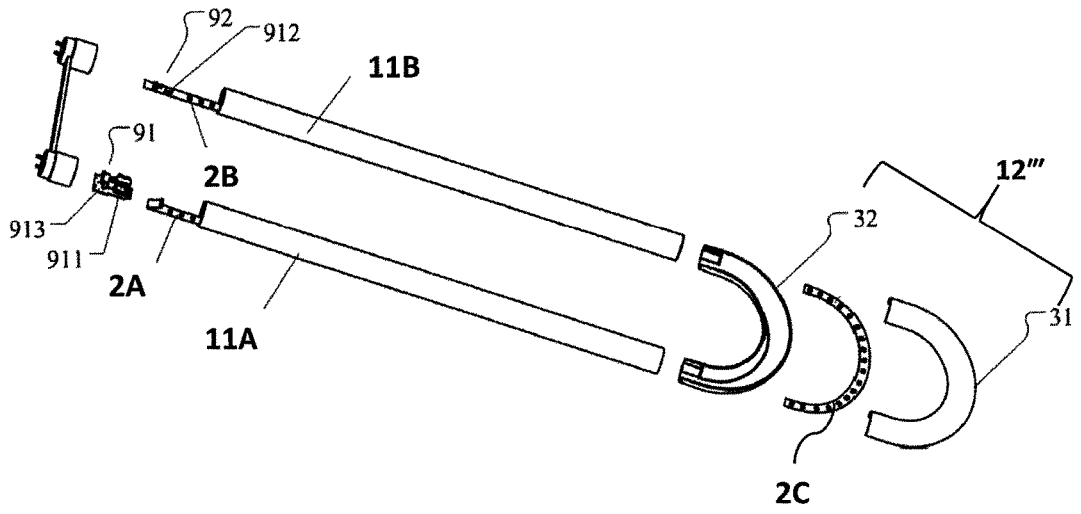
FIG. 23 is an exploded view of the curved LED tubular lamp as illustrated in FIG. 22.
Figure 24:
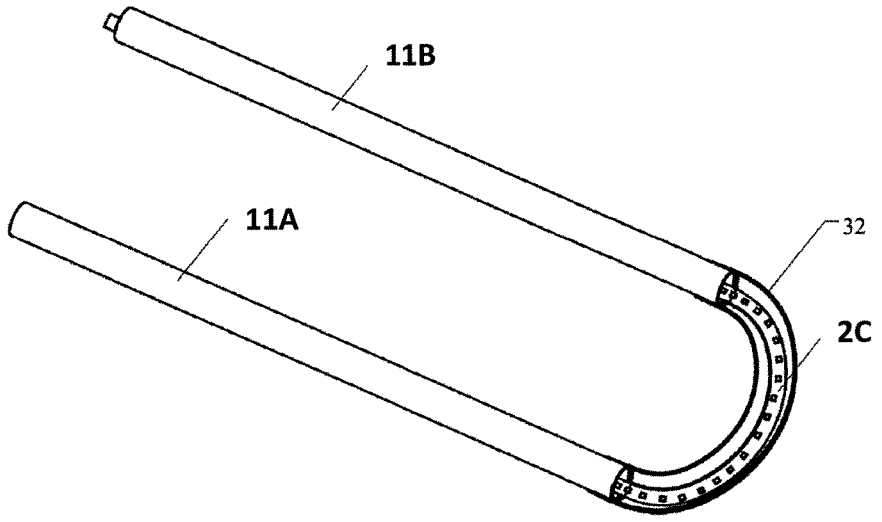
FIG. 24 is a partial perspective view of the curved LED tubular lamp as illustrated in FIG. 22 after removing the second curved upper unit.

The curved LED tubular lamp of this embodiment is similar to the curved lamp of embodiment 3 mentioned above, which comprises a lamp tube 1, an LED light board 2, lamp caps 3 and a driving circuit 4. The difference is the rear supporter 12''' for joining the first straight tube 11A and the second straight tube 11B. As illustrated in FIGS. 22-24, the first straight tube 11A and the second straight tube 11B are assembled as a whole by the rear supporter 12''', and the first straight tube 11A and the second straight tube 11B are both made of a transparent material such as glass or plastic. The rear supporter 12''' is a hollow structure comprising a curved upper unit 31 and a curved lower unit 32, wherein the normal lines to the curved upper unit and the curved lower unit are perpendicular to the longitudinal axes of the first straight tube and the second straight tube, and the curved upper unit 31 is capped on the curved lower unit 32 to assemble the rear supporter 12'''. As the overall structure illustrated in FIG. 22, the rear supporter 12''' comprises two straight segments 12*a*''', 12*b*''', and a curved part 12*c*''', wherein the end terminals of these two straight segments 12*a*''' and 12*b*''' are designed for the first straight tube 11A and the second straight tube 11B to insert therein and join therewith.

Figure 28:
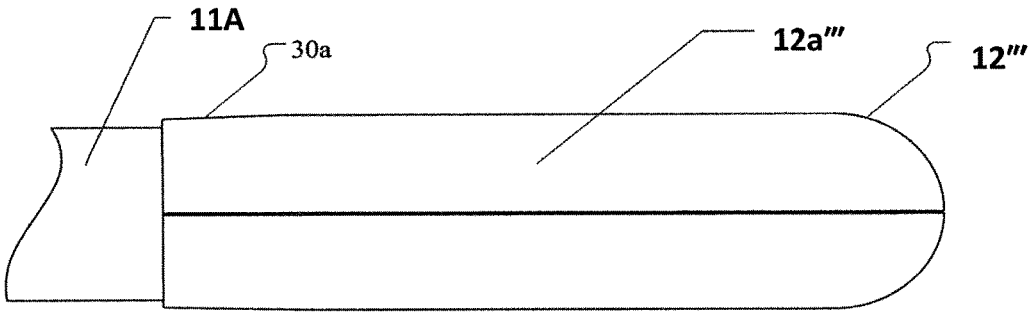
FIG. 28 is an enlarged partial perspective view of the first curved part of the curved LED tubular lamp as illustrated in FIG. 22.

As illustrated in FIG. 28, the outer diameter of the end terminal of the straight segment 12*a*''' increases with the distance away from the joining part of the straight tube 11A and the straight segment 12*a*''' of the rear supporter 12''' to provide a natural and attractive visual appearance.

Figure 25:
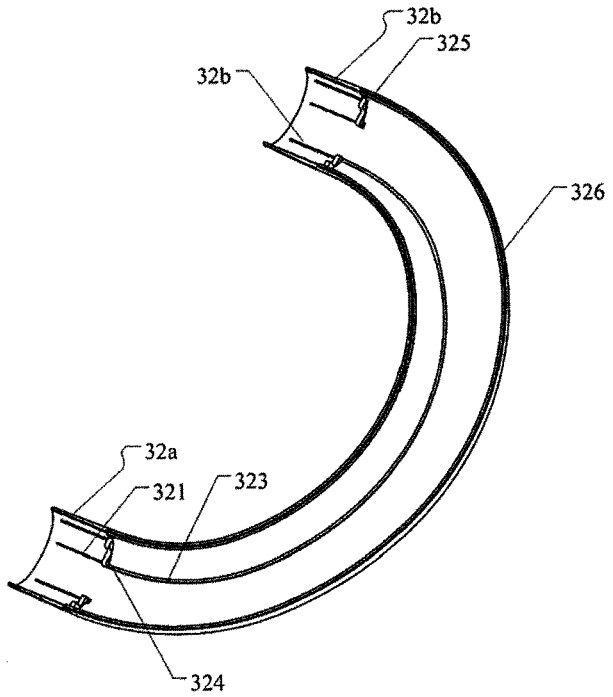
FIG. 25 is a perspective view of the curved lower unit as illustrated in FIG. 22.
Figure 26:
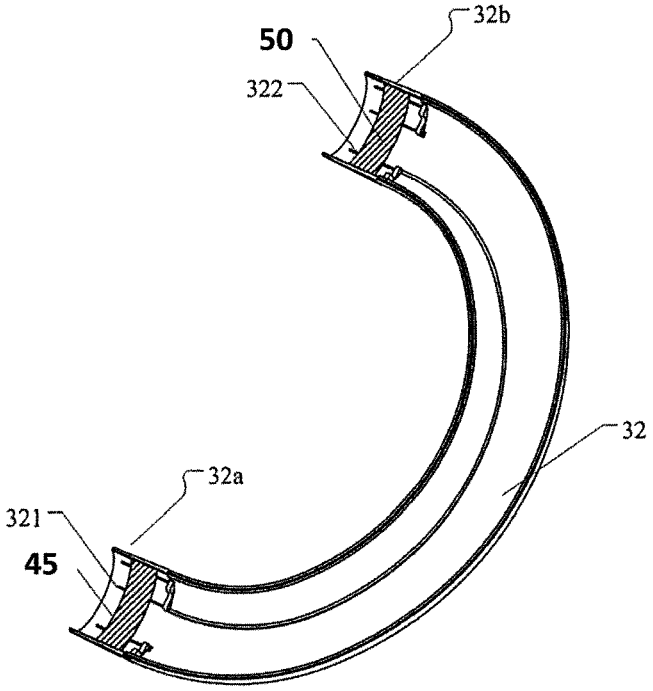
FIG. 26 is a plain view of the curved lower unit as illustrated in FIG. 25 after coating a glue thereon.
Figure 32:
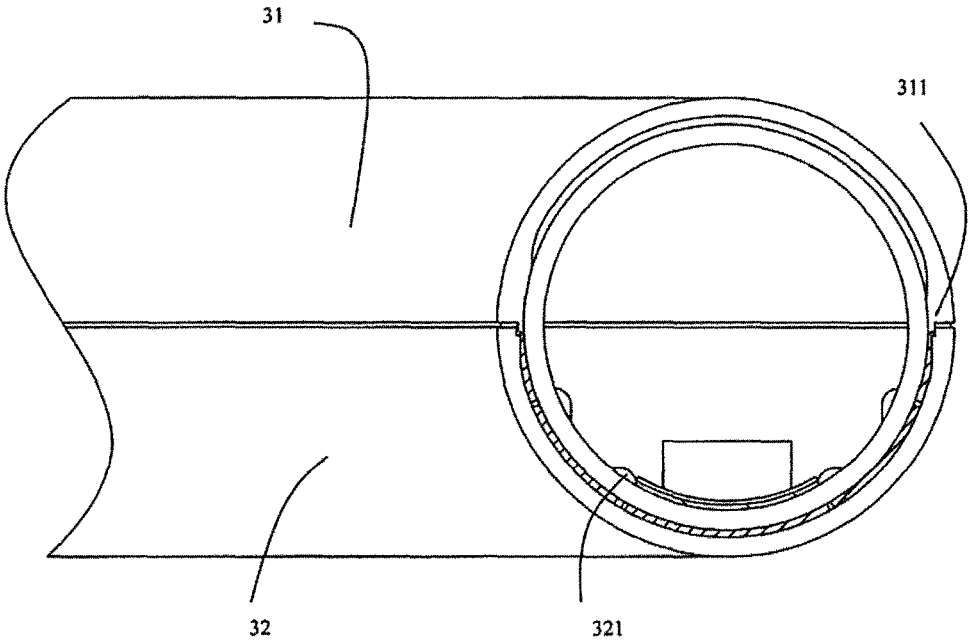
FIG. 32 is another partial cross-sectional view of the curved lamp as illustrated in FIG. 22.

As illustrated in FIGS. 25, 26 and 32, the first end 32*a* of the curved lower unit 32 comprises at least one first protruding rib 321 protruding outward from the inner surface of the first end 32*a* and extended along the longitudinal axis of the first end 32*a* to support the first straight tube 11A by placing the end of the first straight tube 11A thereon and form a first glue-coating space (not labeled) to fasten the first straight tube 11A and the first end 32*a* of the curved lower unit 32 by coating first glue 45 therein. It is understood that sufficient first glue 45 can be coated onto the first glue-coating space between the outer surface of the first straight tube 11A and the first end 32*a* of the curved lower unit 32 to secure that the first straight tube 11A and the curved lower unit 32 can be tightly assembled. Further, the first protruding rib 321 protruding outward from the inner surface of the first end 32*a* and extended along the longitudinal axis of the first end 32*a* make it be easily manufactured and make the first straight tube 11A have longer contact area with the first glue 45 along the longitudinal axis thereof to secure that the curved lower unit 32 can be tightly assembled. Similarly, the second end 32*b* of the curved lower unit 32 comprises at least one second protruding rib 322 protruding outward from the inner surface of the second end 32*b* and extended along the longitudinal axis of the second end 32*b* to support the second straight tube 11B by placing the end of the second straight tube 11B thereon and form a second glue-coating space (not labeled) to fasten the second straight tube 11B and the second end 32*b* of the curved lower unit 32 by coating second glue 50 therein. It is also understood that sufficient second glue 50 can be coated onto the second glue-coating space between the outer surface of the second straight tube 11B and the second end 32*b* of the curved lower unit 32 to secure that the second straight tube 11B and the curved lower unit 32 can be tightly assembled. Further, the second protruding rib 322 protruding outward from the inner surface of the second end 32*b* and extended along the longitudinal axis of the second end 32*ab* make it be easily manufactured and make the second straight tube 11B have longer contact area with the second glue 50 along the longitudinal axis thereof to secure the curved lower unit 32 be tightly assembled.

Figure 30:
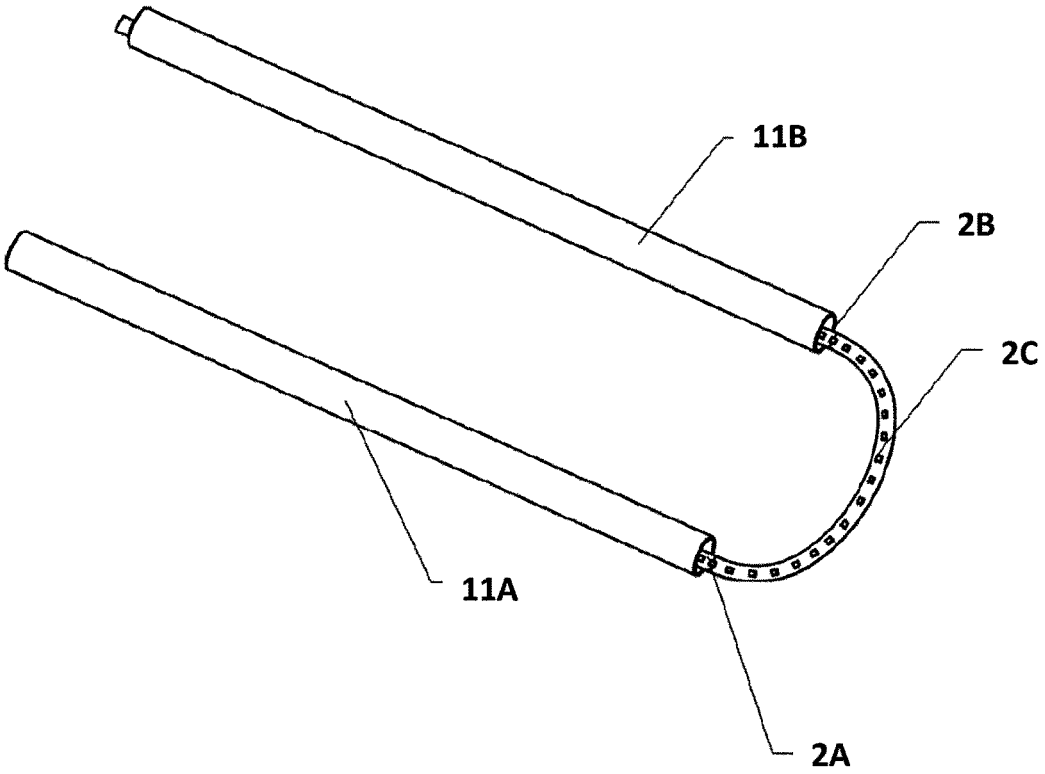
FIG. 30 is a perspective view of the curved LED tubular lamp of the embodiment 4 after removing the rear supporter.
Figure 31:
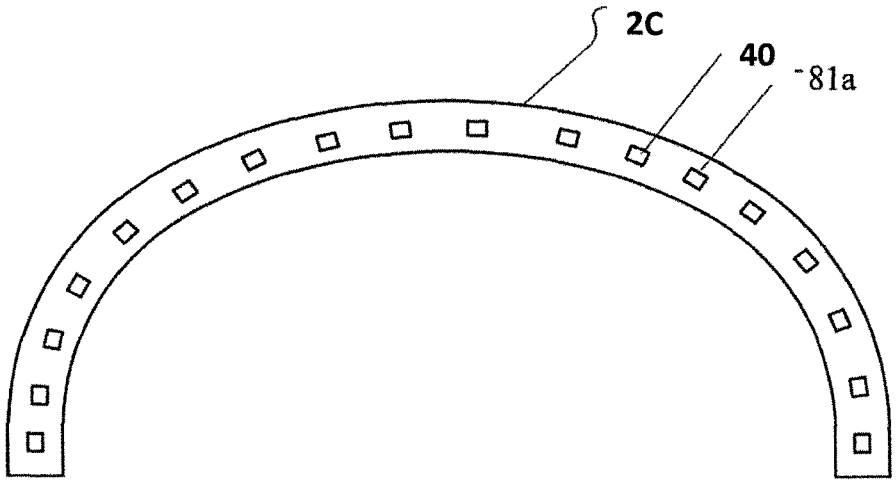
FIG. 31 is a plain view of the middle connecting segment of the curved LED tubular lamp as illustrated in FIG. 22.

As illustrated in FIGS. 30, 32, a first protrusion 311 is formed on the edge of the first end 31*a* of the curved upper unit 31 to stick on (e.g., to contact) the outer surface of the first straight tube 11A and guide it along the longitudinal direction thereof. Also, as illustrated in FIG. 31, a second protrusion 312 is formed on the edge of the second end 31*b* of the curved upper unit 31 to stick on (e.g., to contact) the outer surface of the second straight tube 11B and guide it along the longitudinal direction thereof. According to this present exemplary embodiment, the first protrusion 311 and the second protrusion 312 may be linked with each other by forming the first protrusion 311 and the second protrusion 312 protruding outward from the curved upper unit 31 and respectively extended along the same edge of the curved upper unit 31 from the first end and the second end of the curved upper unit 31. Accordingly, a smooth surface between two edges of the curved upper unit 31 is provided, and the luminous efficiency and uniformity of the curved LED tubular lamp can be enhanced. According to other embodiments of the present disclosure, the curved upper unit 31 can comprises at least one first protrusion 311 and at least one second protrusion 312 formed on other places of the curved upper unit 31.

Figure 27:
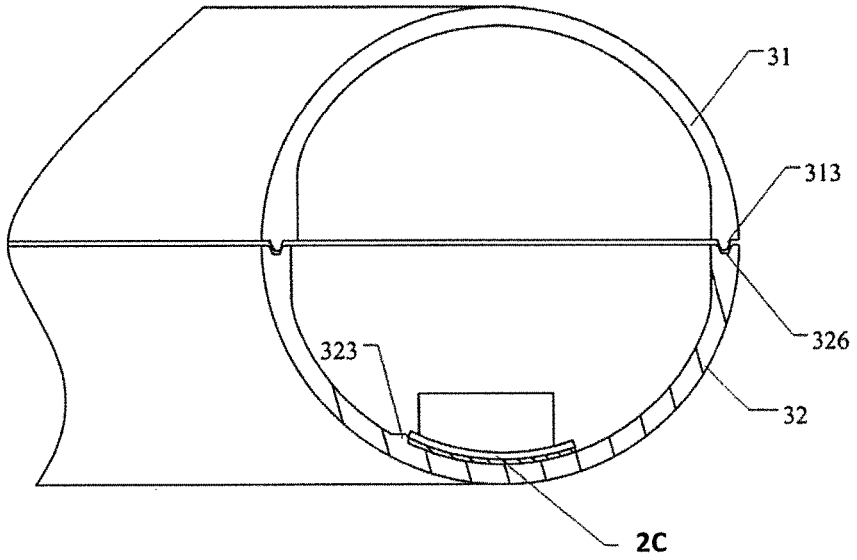
FIG. 27 is a partial cross-sectional view of the curved lamp as illustrated in FIG. 22.

As illustrated in FIGS. 25 and 27, the curved lower unit 32 comprises a curved ridgeline 323 extending along the longitudinal axis of the curved lower unit 32 to press against the side edge of the middle connecting segment 2C for guiding and positioning.

Figure 33:
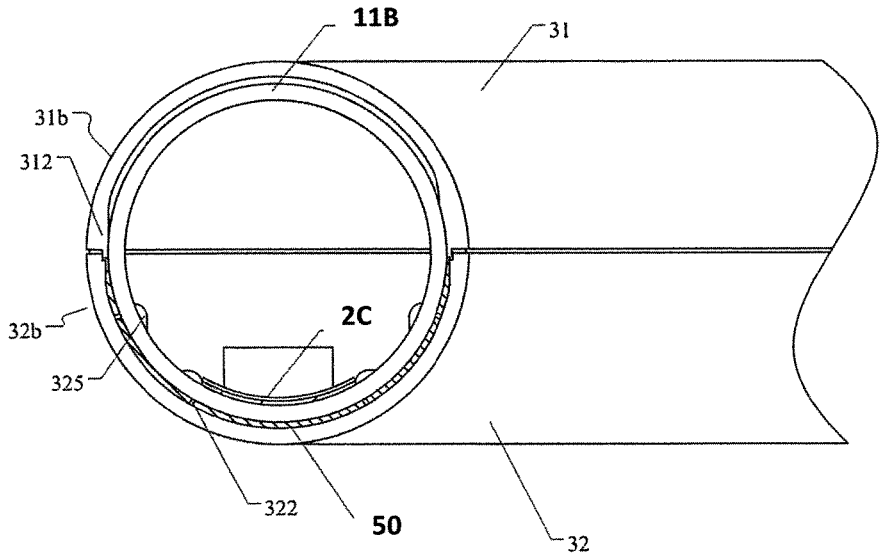
FIG. 33 is another partial cross-sectional view of the curved lamp of embodiment 4 of the present disclosure viewed in another angle.

As illustrated in FIGS. 25 and 32, the first end 32*a* of the curved lower unit 32 further comprises two first baffle plates 324 spaced apart from each other for blocking/pressing against the end terminal of the first straight tube 11A to position the first straight tube 11A when installing. As illustrated in FIGS. 25 and 33, the second end 32*b* of the curved lower unit 32 further comprises two second baffle plates 325 spaced apart from each other for blocking/pressing against the end terminal of the second straight tube 11B to position the second straight tube 11B when installing.

As illustrated in FIGS. 23 and 25, the curved lower unit 32 further comprises a trench 326 on the surface contacting the curved upper unit 31, wherein the trench 326 extends along the edge of the curved lower unit 32. The curved upper unit 31 further comprises a protruded edge 313 for inserting the trench 326, wherein the protruded edge 313 extends along the edge of the curved upper unit 31. By inserting the protruded edge 313 of the curved upper unit 31 into the trench 312 of the curved lower unit 32 to form the rear supporter 12''' can ensure that the curved upper unit 31 and the curved lower unit 32 can be tightly assembled and avoid light leakage.

As illustrated in FIGS. 23 and 30, the first light bar 2A is installed in the first straight tube 11A, the second light bar 2B is installed in the second straight tube 11B, and the middle connecting segment 2C with a plurality of LEDs formed thereon electrically connected to the first light bar 2A and the second light bar 2B is installed in the rear supporter 12'''. In this exemplary embodiment, the first light bar 2A, the second light bar 2B and the middle connecting segment 2C are flexible boards with a plurality of LEDs formed thereon to generate a curved LED tubular lamp without a dark zone. The first light bar 2A may extend from the straight tube 11A and is not being restricted to be within the straight tube 11A; the second light bar 2B may be not being restricted to be within the second straight tube 11B; the middle connecting segment 2C may be not being restricted to be within the rear supporter 12'''.

Figure 29:
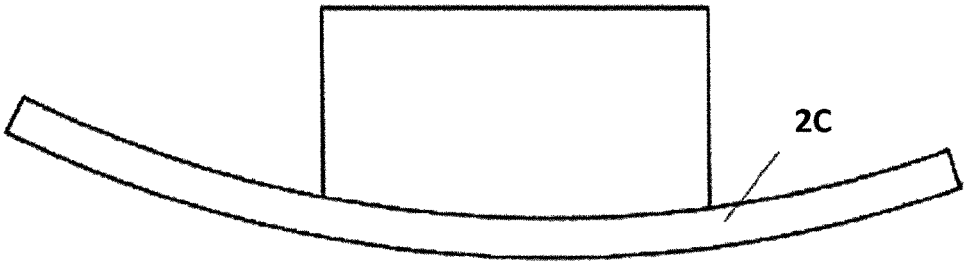
FIG. 29 is a cross-sectional view of the middle connecting segment of the curved LED tubular lamp as illustrated in FIG. 22.

The first light bar 2A, the middle connecting segment 2C and the second light bar 2B can be welded in series by extending the end terminal of the first light bar 2A into the rear supporter 12''', or extending the end terminal of the middle connecting segment 2C into the first straight tube 11A, or extending the end terminal of the second light bar 2B into the rear supporter 12''', or extending the end terminal of the middle connecting segment 2C into the second straight tube 11B. The lighting surface of the middle connecting segment 2C is installed by facing toward the curved upper unit 31, and at least the curved upper unit 31 of the rear supporter 12''' is made of a transparent material, so the whole curved LED tubular lamp can emit uniform light. As illustrated in FIGS. 24 and 29, the middle connecting segment 2C is curved and extends along the axis of the rear supporter 12''', so the lighting of the curved LED tubular lamp can be more uniform.

As illustrated in FIG. 25, the cross-sectional view of the rear supporter 12''' looks like a curve, and the cross-sectional view of the curved lower unit 32 also looks like a curve, which makes the middle connecting segment 2C be contacted with the curved lower unit 32 face-by-face. In addition, the LEDs 40 on the middle connecting segment 2C can be installed on the extending surface 81*a* of the middle connecting segment 2C to make the LEDs be arranged toward a desired angle to enhance the luminous uniformity of the rear supporter 12'''.

Furthermore, as illustrated in FIGS. 22 and 23, the lamp caps and the first front supporter 5 can be integrated as a whole or assembled as a whole as described in the embodiment 1. The driving circuits for driving the first light bar 2A, the second light bar 2B and the middle connecting segment 2C comprise a first driving circuit 91 and a second driving circuit 92. According to this exemplary embodiment, the first driving circuit 91 comprises a first power device 911 formed on an individual circuit board 913 interconnected to the circuit formed thereon, and the second driving circuit 92 comprises a second power device 912 formed on the second light bar 2B and interconnected to the circuit on the second light bar 2B. The driving circuit 91 and the second driving circuit 92 of other embodiments of the present disclosure can also be respectively formed on the first light bar 2A and the second light bar 2B or respectively formed on individual circuit boards.

Exemplary Embodiment 5

The curved LED tubular lamp of this embodiment is similar to the curved lamps mentioned above, which is characterized by the LED light board installed in the first straight tube 11A, the second straight tube 11B and the curved part 13 is free from warpage and the luminous efficiency of the curved LED tubular lamp without a dark zone can be enhanced.

Figure 34:
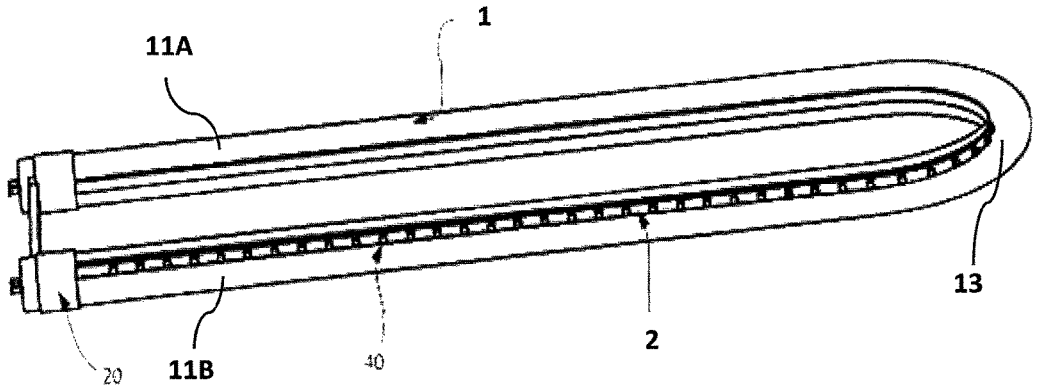
FIG. 34 is a perspective view of a curved LED tubular lamp of the embodiment 5 of the present disclosure.

As illustrated in FIGS. 34 to 40, the curved LED tubular lamp comprises a lamp tube 1 having a first straight tube 11A, a second straight tube 11B parallel to the first straight tube 11A, and a curved part 13 connected to the first straight tube 11A and the second straight tube 11B. The curved part 13 can be the rear supporter 12 integrated as a whole with the first straight tube 11A and the second straight tube 11B as mentioned in the embodiment 1, or the rear supporters 12', 12'' or 12''' assembled as a whole with the first straight tube 11A and the second straight tub 11B as mentioned in embodiments 2, 3 and 4. The lamp tube 1 can be made of plastic or glass to provide better heat dissipation. The shape of the cross-sectional area of the lamp tube 1 can be circular, square or have an irregular shape, but the disclosure is not to limited to circular shape to facilitate the production of the lamp tube. Usually, the curved part 13 has a substantial semicircular structure with a radius angle of about 180 degree. The first straight tube 11A has a first inner wall 111 and an opposite first outer wall 112 along the longitudinal axis of the first straight tube 11A, and the second straight tube 11B has a second inner wall 121 and an opposite second outer wall 122 along the longitudinal axis of the second straight tube 11B, and the curved part 13 has a third inner wall 131 and an opposite third wall 132 along the axis of the curved part 13, wherein the first inner wall 111, the third inner wall 131 and the second inner wall 121 are defined as an inner area (not labeled), and the first outer wall 112, the third outer wall 132 and the second outer wall 122 are defined as an outer area (not labeled). As illustrated in FIG. 34, a part or whole of the surface of the LED light board 2 opposite to the LEDs is attached on the inner area (not labeled) of the lamp tube 1.

Figure 35:
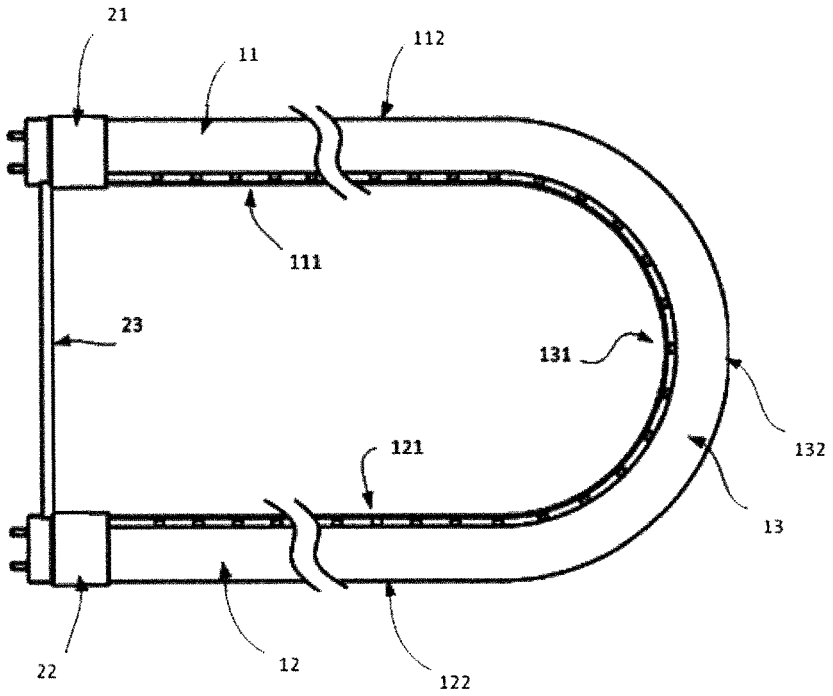
FIG. 35 is a plain view of the curved LED tubular lamp as illustrated in FIG. 34.
Figure 36:
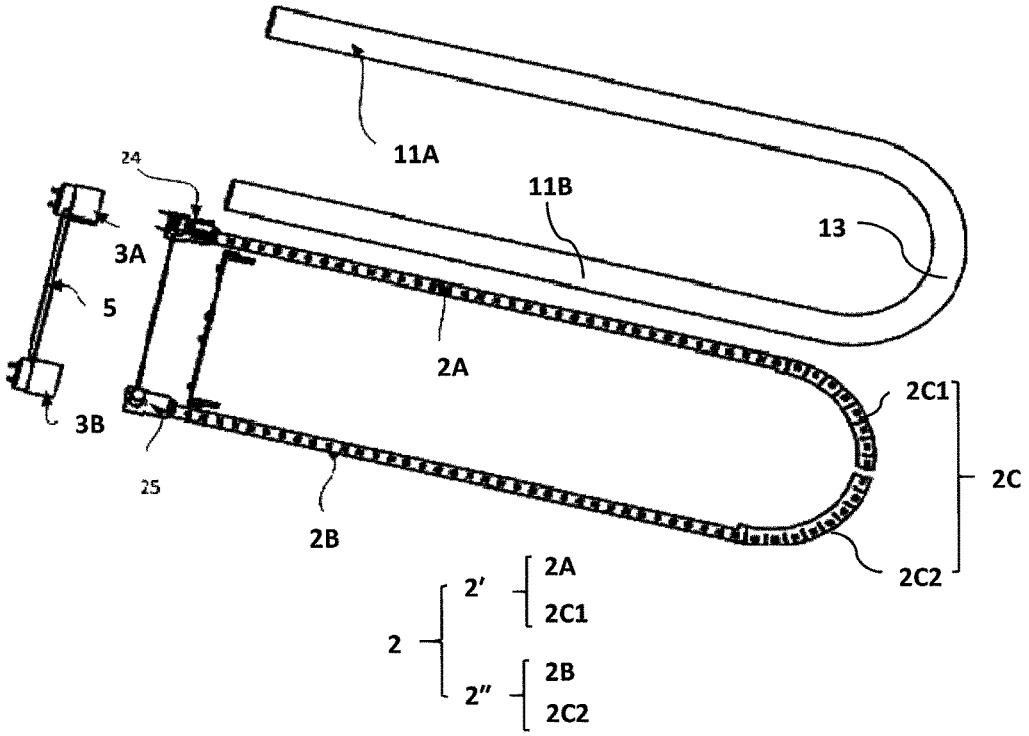
FIG. 36 is an exploded view of the curved LED tubular lamp as illustrated in FIGS. 34 and 35

As illustrated in FIGS. 34 and 35, the LED light board 2 is a flexible circuit board comprising a first light bar 2A with at least one LED formed thereon, a second light bar 2B with at least one LED formed thereon, and a middle connecting segment 2C with at least one LED formed thereon connected with the first light bar 2A and the second light bar 2B. The LEDs on the LED light board 2 can be arranged in a single row in some embodiments or arranged in a matrix in other embodiments. The first light bar 2A is primarily installed in the first straight tube 11A, the second light bar 2B is primarily installed in the second straight tube 11B, and the middle connecting segment 2C is primarily in the curved part 13. The first light bar 2A and the second light bar 2B of the LED light board 2 may extend along the same direction and may be respectively attached on the first inner wall 111 and the second inner wall 121, thus, there is no substantial difference in length between the first light bar 2A and the second light bar 2B, so the warpage of the LED light board 2 can be avoided. The first light bar 2A and the second light bar 2B of the LED light board 2 are attached onto the first inner wall 111 and the second inner wall 121 by a glue to make the LEDs formed thereon to face outward the inner walls 111 and 121. According to other embodiments of the present disclosure, the first light bar 2A and the second light bar 2B of the LED light board 2 can also be attached onto the first inner wall 111 and the second inner 121 by other methods. If the LEDs exist in the first straight tube 11A, the second straight tube 11B and the curved part 13 of the lamp tube 1, the light can be emitted out of the first straight tube 11A, the second straight tube 11B and the curved part 13 of the lamp tube 1. As shown in FIGS. 34, and 35, the LEDs are facing the outer area (not labeled) composed of the first outer wall 112, the second outer wall 122 and the third outer wall 132. Accordingly, compared to conventional LED light board, the above-described structure of the LED light board 2 according to exemplary embodiments may achieve a whole illuminating structure with an enhanced lighting effect as well as resolve the warpage problem suffered by conventional LED light boards.

Figure 37:
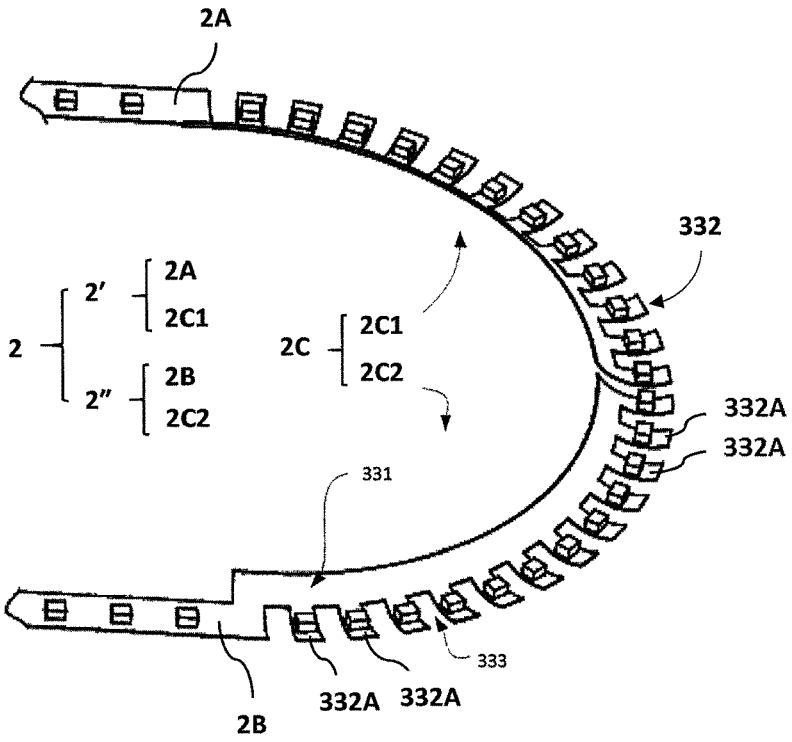
FIG. 37 is an enlarged perspective view of an LED light board applied in the curved LED tubular lamp as illustrated in FIG. 36.

As illustrated in FIG. 37, the first light bar 2A and the second light bar 2B are primarily installed between the inner area and the outer area of the first straight tube 11A and the second straight tube 11B, and the middle connecting segment 2C is compatibly installed in the curved part 13. The middle connecting segment 2C comprises at least one fitting part 331 attached on the inner wall 131 of the curved part 13 and at least one placing part 332 with at least one LED 40 formed thereon installed between the inner wall 131 and the outer wall 132, wherein the fitting part 331 and the placing part 332 both extend in the same direction and the placing part 332 may be wider than the fitting part 331. Also, the middle connecting segment 2C may be wider than the first linear straight lighting part 2A and the second linear straight lighting part 2B. The warpage of the LED light board 2 happened in the curved part 13 of the lamp tube 1 can be avoided by forming the fitting part 331 in the middle connecting segment 2C to make the middle connecting segment 2C be tightly attached onto the inner wall 131 of the curved part 13.

As illustrated in FIG. 37, to facilitate the placement of the LEDs 40 and ensure the LED light board 2 not to be warped, the placing part 332 may be designed to be wider than the fitting part 331. The placing part 332 of this embodiment may be perpendicular to the fitting part 331, but the disclosure is not limited thereto. For example, in some embodiments, the placing part 332 may not be perpendicular to the fitting part 331 and may have a suitable angle therebetween to overcome the warpage of the LED light board 2. The placing part 332 and the fitting part 331 along the latitudinal direction of the LED light board 2 may have a curved surface or a vertical surface. In addition, to avoid the warpage of the LED light board 2, the placing part 332 may comprise a plurality of placing pieces 332A spaced apart from each other to ensure the leveling and the lighting performance of the LED light board 2 when the placing part 332 and the fitting part 331 along the latitudinal direction of the LED light board 2 include a curved surface. Each placing piece 332A comprises at least one LED 40 as illustrated in FIG. 37.

Figure 39:
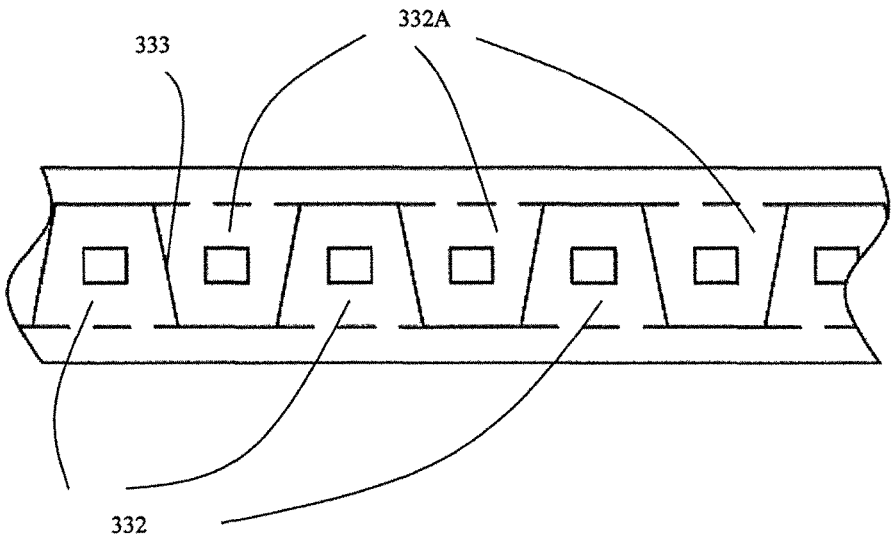
FIG. 39 is an LED light board for the curved LED tubular lamp according to embodiment 5 of the present disclosure.

According to another embodiment of the present disclosure, as shown in FIG. 39, the spacer 333, i.e., notches between two adjacent placing pieces 332 and each spacer 333 are designed of substantially the same shapes to increase the utilization percentage of the raw material. As illustrated in FIG. 39, the LED light board 2 having a plurality of placing pieces 332, and another LED light board having a plurality of placing pieces 332A can be manufactured at the same time by only one dicing process with minimum raw material.

Moreover, to facilitate the installing of a longer LED light board 2 into the LED tubular lamp tube 1, the middle connecting segment 2C used to connect the first light bar 2A and the second light bar 2B is separated into a first middle connecting segment 2C1 and a second middle connecting segment 2C2, wherein the first middle connecting segment 2C1 and the first light bar 2A are joined to formed a first LED light board 2', and the second middle connecting segment 2C2 and the second light bar 2B are joined to formed a second LED light board 2". Accordingly, the first LED light board 2' and the second LED light board 2" can be respectively inserted into the first straight tube 11A and the second straight tube 11B from the same ends thereof. Furthermore, in some embodiments, the length of the first LED light board 2' can be equal to that of the second LED light board 2". In some embodiments, the length of the first LED light board 2' may not be equal to that of the second LED light board 2". In addition, the separation part of the first LED light board 2' and the second LED light board 2" is located within the curved part 13.

Figure 38:
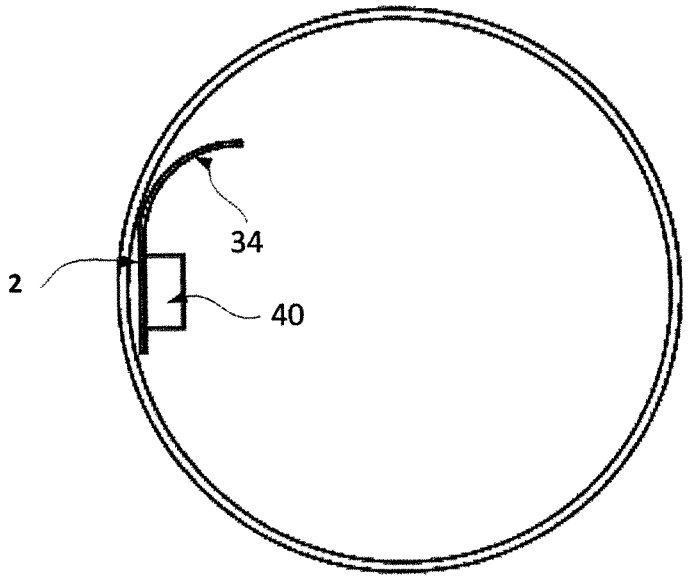
FIG. 38 is cross-sectional view of the curved LED tubular lamp illustrating the LED light board attached on the inner surface of the curved lamp tube as illustrated in FIG. 36.

The LED light board 2 further may comprise a reflector 34 extended from the fitting part 331 or the placing piece 332 to reflect the light emitted by at least one of the LEDs 40 to enhance the luminance of the curved LED tubular lamp, wherein the reflector 34 can be formed by coating a reflecting material on the upper surface of the LED light board 2. As illustrated in FIG. 38, the LED light board 2 comprises a base (not labeled) for forming an LED 40 thereon, and a reflector 34 extended from one end of the base (not labeled).

Furthermore, the light efficiency of the LED tubular lamp can be enhanced by forming the LEDs 40 on one edge of the LED light board 2 adjacent to the base (not labeled) mentioned above, and forming the reflector 34 on the other edge of the LED light board 2 to make the reflector 34 bend toward at least one of the LEDs 34. The reflector 34 can be bent in many ways, for example be bent along a folded line (i.e., the cross-sectional view is a folded line) or be bent along a curve (i.e., the cross-sectional view is a curve).

Figure 40:
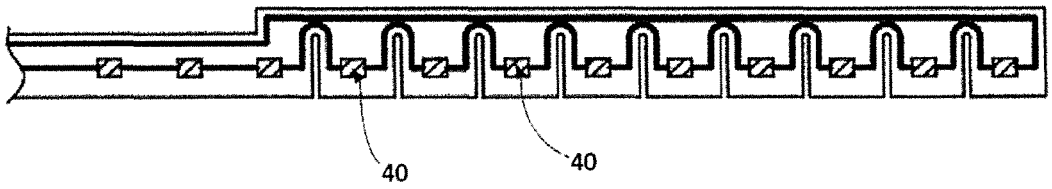
FIG. 40 is a plain view of an LED light board with a plurality of LEDs formed thereon and interconnected in series for the curved LED tubular lamp of the embodiment 5 of the present disclosure.

Furthermore, the difficulty of layout resulting from the narrow LED light board 2 can be overcome by interconnecting the LEDs 40 in series as illustrated in FIG. 40. When the LED light board 2 is a single piece, the LEDs 40 formed thereon are all interconnected in series; when the LED light board 2 is comprised of the first LED light board 2' and the second LED light board 2", the LEDs 40 formed thereon are respectively interconnected in series.

It should be understood that the relation between a pair parts, e.g., a first part and a second part in the present disclosure, for example, the first rear supporter 12A' and the second rear supporter 12B' in FIG. 9-13; the first curved part 51 and the second curved part 51 in FIG. 15-21; the curved upper unit 31 and the curved lower unit 32, can be construed as "one" and "the other", and each feature described herein is independent and not limited to being belonging to specific one of the pair parts. For example, as shown in FIG. 19, the positioning pillars 513 and the hooks 517 are disposed at the same side (i.e., the first curved part 51), the positioning caps 523 and the buckles 526 are disposed at the same side (i.e., the second curved part 52) though, the position pillars 513 can be at the same side with the buckles 526, or even be disposed at a curved part without any hooks/buckles.

While the disclosure has been described by way of example and in terms of the exemplary embodiments, it is to be understood that the disclosure is not limited to the disclosed embodiments. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A curved LED tubular lamp, comprising:

a curved lamp tube having two straight segments, and a curved segment disposed between the two straight segments; and a first light board and a second light board respectively disposed in each of the two straight segments;

wherein each of the first light board and second light board has a plurality of LEDs disposed thereon;

wherein the first light board and the second light board are separated into at least two segments;

wherein the first light board includes a first straight portion disposed in a first straight segment of the two straight segments of the curved lamp tube, and a first curved portion disposed in a first part of the curved segment of the curved lamp tube; and wherein the second light board includes a second straight portion disposed in a second straight segment of the two straight segments of the curved lamp tube, and a second curved portion disposed in a second part of the curved segment of the curved lamp tube.

2. The curved LED tubular lamp of claim 1, wherein the curved segment comprises a middle connecting segment used to visually connect the plurality of LEDs of the first light board and the second light board, and the middle connecting segment is separated into a first middle connecting segment and a second middle connecting segment, wherein the first middle connecting segment is part of the first light board, and the second middle connecting segment is part of the second light board.

3. The curved LED tubular lamp of claim 2, wherein the length of the first light board is equal to the length of the second light board.

4. The curved LED tubular lamp of claim 1, wherein the curved LED tubular lamp further comprises one or more driving circuits, disposed in one or both of the straight segments of the curved LED tubular lamp.

5. The curved LED tubular lamp of claim 1, wherein the curved LED tubular lamp includes two straight tubes and a rear supporter disposed between the two straight tubes, the rear supporter including a first piece having a protruded edge extending along an edge of the first piece and a second piece having a trench extending along an edge of the second piece, wherein the protruded edge is inserted into the trench, providing tight assembly of the rear supporter.

6. The curved LED tubular lamp of claim 1, wherein the second straight portion of the second light board is attached on an inner wall of the second straight segment of the two straight segments of the curved lamp tube, and the second curved portion is attached to the second part of the curved segment of the curved lamp tube.

7. The curved LED tubular lamp of claim 1, wherein the first light board and the second light board are separated to have a gap between each of the at least two segments.

8. The curved LED tubular lamp of claim 1, wherein an end of the first curved portion faces an end of the second curved portion.

9. The curved LED tubular lamp of claim 8, wherein a gap is formed between the end of the first curved portion and the end of the second curved portion.

10. The curved LED tubular lamp of claim 1, wherein:

the first curved portion is attached to the first part of the curved segment of the curved lamp tube; and the second curved portion is attached to the second part of the curved segment of the curved lamp tube.

11. A curved LED tubular lamp, comprising:

a curved lamp tube having two straight segments, and a curved segment disposed between the two straight segments; and a first light board and a second light board respectively disposed in each of the two straight segments;

wherein each of the first light board and second light board has a plurality of LEDs disposed thereon;

wherein the first light board and the second light board are two separate pieces;

wherein the first light board includes a first straight portion disposed in a first straight segment of the two straight segments of the curved lamp tube, and a first curved portion disposed in a first part of the curved segment of the curved lamp tube; and wherein the second light board includes a second straight portion disposed in a second straight segment of the two straight segments of the curved lamp tube, and a second curved portion disposed in a second part of the curved segment of the curved lamp tube.

12. The curved LED tubular lamp of claim 11, wherein the curved segment comprises a middle connecting segment used to visually connect the plurality of LEDs of the first light board and the second light board, and the middle connecting segment is separated into a first middle connecting segment and a second middle connecting segment, wherein the first middle connecting segment is part of the first light board, and the second middle connecting segment is part of the second light board.

13. The curved LED tubular lamp of claim 12, wherein the length of the first light board is equal to the length of the second light board.

14. The curved LED tubular lamp of claim 11, wherein the curved LED tubular lamp further comprises one or more driving circuits, disposed in one or both of the straight segments of the curved LED tubular lamp.

15. The curved LED tubular lamp of claim 11, wherein the curved LED tubular lamp includes two straight tubes and a rear supporter disposed between the two straight tubes, the rear supporter including a first piece having a protruded edge extending along an edge of the first piece and a second piece having a trench extending along an edge of the second piece, wherein the protruded edge is inserted into the trench, providing tight assembly of the rear supporter.

16. The curved LED tubular lamp of claim 11, wherein the second straight portion of the second light board is attached on an inner wall of the second straight segment of the two straight segments of the curved lamp tube, and the second curved portion is attached to the second part of the curved segment of the curved lamp tube.

17. The curved LED tubular lamp of claim 11, wherein the first light board and the second light board are separated to have a gap, in the curved segment of the curved lamp tube, between the two pieces.

18. The curved LED tubular lamp of claim 11, wherein an end of the first curved portion faces an end of the second curved portion.

19. The curved LED tubular lamp of claim 18, wherein a gap is formed between the end of the first curved portion and the end of the second curved portion.

20. The curved LED tubular lamp of claim 11, wherein:

the first curved portion is attached to the first part of the curved segment of the curved lamp tube; and the second curved portion is attached to the second part of the curved segment of the curved lamp tube.

* * * * *